US009656498B2

(12) United States Patent
Yamane et al.

(10) Patent No.: US 9,656,498 B2
(45) Date of Patent: May 23, 2017

(54) HEAT-SENSITIVE RECORDING BODY

(71) Applicant: OJI HOLDINGS CORPORATION, Tokyo (JP)

(72) Inventors: Kazuo Yamane, Amagasaki (JP); Naotaka Endo, Amagasaki (JP); Hiroyuki Kido, Amagasaki (JP); Kazuyuki Sakamoto, Amagasaki (JP)

(73) Assignee: OJI HOLDINGS CORPORATION, Tokyo (JP)

( * ) Notice: Subject to any disclaimer, the term of this patent is extended or adjusted under 35 U.S.C. 154(b) by 0 days.

(21) Appl. No.: 14/764,750

(22) PCT Filed: Feb. 7, 2014

(86) PCT No.: PCT/JP2014/052920
§ 371 (c)(1),
(2) Date: Jul. 30, 2015

(87) PCT Pub. No.: WO2014/126018
PCT Pub. Date: Aug. 21, 2014

(65) Prior Publication Data

US 2015/0367663 A1 Dec. 24, 2015

(30) Foreign Application Priority Data

| | | |
|---|---|---|
| Feb. 13, 2013 | (JP) | 2013-025523 |
| Mar. 6, 2013 | (JP) | 2013-043891 |
| Mar. 6, 2013 | (JP) | 2013-043947 |
| Jun. 19, 2013 | (JP) | 2013-128380 |

(51) Int. Cl.

| | |
|---|---|
| ***B41M 5/333*** | (2006.01) |
| ***B41M 5/41*** | (2006.01) |
| ***B41M 5/327*** | (2006.01) |
| ***B41M 5/337*** | (2006.01) |
| ***B41M 5/44*** | (2006.01) |
| *B41M 5/323* | (2006.01) |
| *B41M 5/42* | (2006.01) |

(52) U.S. Cl.
CPC ..... *B41M 5/3336* (2013.01); *B41M 5/3275* (2013.01); *B41M 5/3331* (2013.01); *B41M 5/3333* (2013.01); *B41M 5/3375* (2013.01); *B41M 5/41* (2013.01); *B41M 5/44* (2013.01); *B41M 5/323* (2013.01); *B41M 5/42* (2013.01); *B41M 2205/04* (2013.01); *B41M 2205/38* (2013.01)

(58) Field of Classification Search
CPC .. B41M 5/333; B41M 5/3333; B41M 5/3336; B41M 2205/04
USPC ..... 503/216; 106/31.17
See application file for complete search history.

(56) References Cited

U.S. PATENT DOCUMENTS

| | | | | |
|---|---|---|---|---|
| 6,921,740 | B1 * | 7/2005 | Hizatate | B41M 5/3333 503/200 |
| 2007/0042907 | A1 | 2/2007 | Nagasawa | |
| 2015/0284321 | A1 * | 10/2015 | Sakai | B41M 5/155 428/195.1 |

FOREIGN PATENT DOCUMENTS

| | | | |
|---|---|---|---|
| EP | 1 116 713 | A1 | 7/2001 |
| JP | H04-286685 | | 10/1992 |
| JP | H07-205545 | | 8/1995 |
| JP | H08-197846 | | 8/1996 |
| JP | H11-503110 | | 3/1999 |
| JP | H11-268421 | | 10/1999 |
| JP | 2000-504722 | | 4/2000 |
| JP | 2002-144746 | A1 | 5/2002 |
| JP | 2002-160462 | A1 | 6/2002 |
| JP | 2003-72246 | A1 | 3/2003 |
| JP | 3664840 | B2 | 6/2005 |
| JP | 2010-284939 | A1 | 12/2010 |
| JP | 2015157478 | A | 9/2015 |
| WO | WO 96/25157 | A1 | 8/1996 |
| WO | WO 97/29743 | A1 | 8/1997 |
| WO | WO 00/14058 | A1 | 3/2000 |
| WO | WO 2005/042263 | A1 | 5/2005 |
| WO | 2014080615 | A1 | 5/2014 |

OTHER PUBLICATIONS

International Search Report for International Application No. PCT/JP2014/052920 dated Apr. 28, 2014.
Hatsumei Suishin Kyokai Kokai Giho (Journal of Technical Disclosure) No. 2012-504442, with partial translation. Cited in Office Actions dated Jan. 5, 2016 and Jan. 12, 2016 for corresponding JP patent applications.

* cited by examiner

*Primary Examiner* — Bruce H Hess
(74) *Attorney, Agent, or Firm* — Kratz, Quintos & Hanson, LLP

(57) ABSTRACT

The present invention provides a heat-sensitive recording material having a high recording density, excellent plasticizer resistance in recorded portions, and excellent resistance to thermal background fogging in high-temperature environments. The heat-sensitive recording material includes a heat-sensitive recording layer containing a specific sulfonamide compound.

18 Claims, No Drawings

HEAT-SENSITIVE RECORDING BODY

TECHNICAL FIELD

The present invention relates to a heat-sensitive recording material using a color-developing reaction between a leuco dye and developer(s).

BACKGROUND ART

Heat-sensitive recording materials, which produce a recorded image by thermally reacting a colorless or pale-colored leuco dye with a developer, which acts as an electron donor for the leuco dye, to develop a color, are well known.

Such heat-sensitive recording materials can be used, for example, in the areas of cash register receipts for POS (point-of-sale) systems, and paper for tickets. With the expansion of POS systems, the environments and methods in which heat-sensitive recording materials are used are diversifying, and use in harsh conditions is also increasing. Further, in such applications, heat-sensitive recording materials are also used as receipts. Therefore, the recorded area must have good preservability against oils, plasticizers, office supplies, hand creams, and various chemicals, as well as high suitability for stamping.

Since the color-developing reaction in heat-sensitive recording materials comprising a heat-sensitive coloring layer mainly comprising a leuco dye and a developer and formed on a support is a reversible reaction, color-developed images are known to fade with time. This color-fading reaction is accelerated in a high-temperature, high-humidity environment, and further progresses rapidly when the heat-sensitive recording layer is brought into contact with oils, plasticizers, etc., and color may fade to such an extent that recorded images become illegible. Further, food labels and labels attached to, for example, test tubes in hospitals may have a high-concentration alcohol solution dropped on them. This leads to background coloration, and color fading in the printed part, which in the worst cases may result in the recorded images becoming illegible. To overcome these problems, for example, PTL (Patent Literature) 1 proposes adding an epoxy compound into a heat-sensitive recording layer to improve preservability of recorded images, but sufficient effects against oils, plasticizers, etc., are not obtained. With recent progress in the development of developers with high preservability, for example, PTL 2 proposes adding a urea-urethane compound into a heat-sensitive recording layer. As a result, the above problems are being solved, but there is a problem of low recording sensitivity. To improve the stability (resistance to thermal background fogging) of unprinted portions, using a developer with a high melting point is effective. However, this method also has a problem of low recording sensitivity, and its application to recent high-speed printers or battery-operated handheld device printers is difficult.

To solve this problem, PTL 3, PTL 4, and PTL 5 propose using as a developer a combination of N-p-toluenesulfonyl-N'-3-(p-toluensulfonyloxy)phenylurea and 4,4'-bis[(4-methyl-3-phenoxycarbonylaminophenyl)ureide]diphenylsulfone or a combination of at least one diphenylsulfone-crosslinked compound and at least one specific hydroxydiphenylsulfone derivative. However, the heat-sensitive recording material disclosed in PTL 3 has a problem of discoloration (background fogging) of the blank-paper part with time. To prevent background fogging, the heat-sensitive recording material disclosed in PTL 4 comprises an organic compound containing nitrogen as a fogging inhibitor. However, because organic compounds containing nitrogen have strong color-fading properties, preservability decreases. Further, the heat-sensitive recording material disclosed in PTL 5 has improved preservability against oils and plasticizers in the recorded part, but has insufficient stability (resistance to thermal background fogging) in the unprinted part.

PTL 6 proposes using urea-urethane compounds, such as 4,4'-bis[(4-methyl-3-phenoxycarbonylaminophenyl)ureido]diphenylsulfone, as developers. However, while the compound disclosed in PTL 6 has excellent image preservability, its sensitivity is insufficient for uses requiring high sensitivity. Further, the compound disclosed in PTL 5 significantly reduces whiteness of a coating liquid comprising the compound due to coloration over time (liquid fogging), and a heat-sensitive recording material produced by applying this coating liquid also has significant coloration in the background portion (background fogging). Furthermore, when the heat-sensitive recording material is stored in a high-humidity environment, significant coloration of the background portion (resistance to wet background fogging) of the heat-sensitive recording material also occurs. There is also a problem that when the compound is used with other developers, liquid fogging and resistance to wet background fogging become even more significant.

To improve the resistance to wet-background fogging of a heat-sensitive recording material comprising 4,4'-bis[(4-methyl-3-phenoxycarbonylaminophenyl)ureido]diphenylsulfone, PTL 7 proposes heat-treating a dispersion produced by co-dispersion of 4,4'-bis[(4-methyl-3-phenoxycarbonylaminophenyl)ureido]diphenylsulfone in the presence of a coloring inhibitor such as silicate, and using the dispersion. However, due to its low recording sensitivity, the heat-sensitive recording material disclosed in PTL 7 has insufficient preservability against oils and plasticizers in the recorded part when applied to a high-speed printer or a battery-operated handheld device printer.

Further, with expansion of areas in which heat-sensitive recording materials are applied, and increased diversification and higher performance of recording devices, the environments where recording media are used are becoming more demanding. Not only high recorded-image quality, sensitivity, and image preservability, but also satisfactory long-term blank-paper preservability, i.e., initial properties, are required of the recording medium without deterioration even after long-term storage as blank paper before recording.

High-quality paper has been generally used as a support for heat-sensitive recording materials. In acidic papermaking, paper is produced by internally adding a rosin-based sizing agent and a filler such as clay and talc. Aluminium sulfate is generally used as a Fixing agent of the rosin sizing agent. Due to the sulfate radicals (sulfate ions) remaining in the paper, the pH on paper is in an acidic range. Accordingly, a color-developing substance contained in the heat-sensitive recording paper reacts with acidic ions on the paper surface and is more prone to cause background fogging during a long-term storage. Therefore, in order to prevent background fogging or reduce papermaking costs, neutral paper comprising an alkaline filler, such as calcium carbonate, is sometimes used as a support for heat-sensitive recording materials.

However, when neutral paper is used as a support for heat-sensitive recording materials, color-developing ability decreases before recording, or colors fade after recording, thereby making recorded images blurred, unclear, or, in some cases, almost illegible, during the storage of heat-sensitive recording materials, for example, within less than one year. In particular, when color-developing ability decreases before recording, decreased printing density of the heat-sensitive recording material causes difficulty in reading printed images, and the essential function as a heat-sensitive recording material is lost. Although the reason for the decrease in color-developing ability is not clear, it is presumed that a developer forms a salt with an alkaline filler contained in neutral paper and changes morphologically, thus resulting in decreased performance of the developer.

To solve the above problem, PTL 8 proposes using, as a support, neutral paper comprising an alkyl ketene dimer as a synthetic sizing agent, the zeta potential of a 0.02% dispersion or solution of the synthetic sizing agent (on a solids basis) at a pH of 8.0 being +20 mV or less. PTL 9 proposes forming a heat-sensitive recording layer comprising an alkali salt of a diisobutylene-maleic anhydride copolymer on neutral paper comprising an alkyl ketene dimer as a sizing agent. However, satisfactory results have not necessarily been obtained.

CITATION LIST

PTL

PTL 1: JPH4-286685A
PTL 2: JP2002-144746A
PTL 3: JP2002-160462A
PTL 4: JP2003-72246A
PTL 5: Japanese Patent No. 3,664,840
PTL 6: WO2000/014058
PTL 7: WO2005/042263
PTL 8: JPH7-205545A
PTL 9: JPH8-197846A

SUMMARY OF INVENTION

Technical Problem

A principal object of the present invention is to provide a heat-sensitive recording material that has a high recording density, excellent alcohol or oil resistance and plasticizer resistance in the recorded part, and excellent resistance to thermal background fogging in high-temperature environments.

Another principal object of the present invention is to provide a heat-sensitive recording material having excellent blank-paper preservability when neutral paper is used as a support.

Solution to Problem

The present inventors carried out extensive research in view of the above prior art problem. As a result, the inventors have found a solution to the problem. More specifically, the present invention provides the following heat-sensitive recording materials.

Item 1: A heat-sensitive recording material comprising at least a heat-sensitive recording layer formed on a support, the heat-sensitive recording layer comprising a leuco dye and developers, the developers including a sulfonamide compound represented by formula (1):

(1)

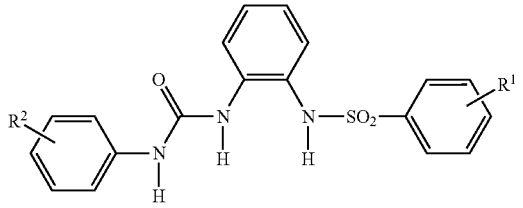

(wherein $R^1$ and $R^2$ may be the same or different, and each represents a hydrogen atom, an alkyl group having 1 to 4 carbon atoms, an alkoxy group having 1 to 4 carbon atoms, or a halogen atom), and further including at least one member selected from the group consisting of a urea-urethane compound represented by formula (2):

(2)

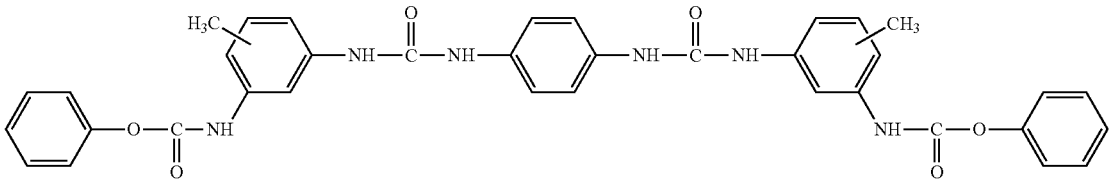

and a diphenylsulfone-crosslinked compound represented by formula (3):

(3)

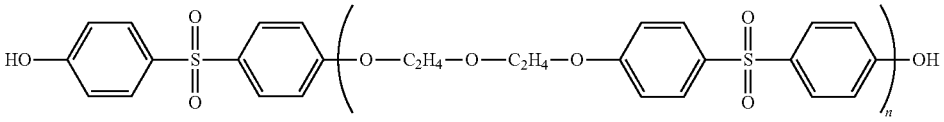

(wherein n is an integer of 1 to 6).

Item 2: The heat-sensitive recording material according to Item 1, wherein the sulfonamide compound represented by formula (1) is N-[2-(3-phenylureido)phenyl]benzenesulfonamide.

Item 3: The heat-sensitive recording material according to Item 1 or 2, wherein the developers include the sulfonamide compound represented by formula (1), the urea-urethane compound represented by formula (2), and the diphenylsulfone-crosslinked compound represented by formula (3).

Item 4: The heat-sensitive recording material according to any one of Items 1 to 3, wherein the sulfonamide compound represented by formula (1) is present in an amount of 0.5 to 5 parts by mass per part by mass of the leuco dye.

Item 5: The heat-sensitive recording material according to any one of Items 1 to 4, wherein the urea-urethane compound represented by formula (2) is present in an amount of 0.03 to 2.5 parts by mass per part by mass of the sulfonamide compound represented by formula (1).

Item 6: The heat-sensitive recording material according to any one of Items 1 to 5, wherein the diphenylsulfone-crosslinked compound represented by formula (3) is present in amount of 0.1 to 2.5 parts by mass per part by mass of the sulfonamide compound represented by formula (1).

Item 7: The heat-sensitive recording material according to any one of Items 1 to 6, wherein the urea-urethane compound represented by formula (2) is present in an amount of 0.2 to 5 parts by mass per part by mass of the diphenylsulfone-crosslinked compound represented by formula (3).

Item 8: The heat-sensitive recording material according to any one of Items 1 to 7, wherein the total amount of the urea-urethane compound represented by formula (2) and the diphenylsulfone-crosslinked compound represented by formula (3) is 0.2 to 3 parts by mass per part by mass of the sulfonamide compound represented by formula (1).

Item 9: The heat-sensitive recording material according to Item 8, wherein the urea-urethane compound represented by formula (2) and the diphenylsulfone-crosslinked compound represented by formula (3) are each present in an amount of 2.5 mass % or more, and the sulfonamide compound represented by formula (1) is present in an amount of 15 to 90 mass %, based on the total amount of the developers.

Item 10: The heat-sensitive recording material according to any one of Items 1 to 9, wherein the urea-urethane compound of formula (2) contained as a developer is a compound heat-treated in advance in the presence of a basic inorganic pigment.

Item 11: The heat-sensitive recording material according to any one of Items 1 to 10, wherein the urea-urethane compound represented by formula (2) is 4,4'-bis[(4-methyl-3-phenoxycarbonylaminophenyl)ureido]diphenylsulfone.

Item 12: The heat-sensitive recording material according to Item 10 or 11, wherein the basic inorganic pigment is at least one member selected from the group consisting of magnesium compounds, aluminium compounds, calcium compounds, titanium compounds, magnesium silicate, magnesium phosphate, and talc.

Item 13: The heat-sensitive recording material according to any one of Items 1 to 12, further comprising an undercoat layer between the support and the heat-sensitive recording layer.

Item 14: The heat-sensitive recording material according to Item 13, wherein the undercoat layer comprises hollow plastic particles.

Item 15: The heat-sensitive recording material according to Item 13 or 14, wherein the undercoat layer is formed by blade coating.

Item 16: The heat-sensitive recording material according to any one of Items 1 to 15, wherein at least one layer on or above the support is formed by curtain coating.

Item 17: The heat-sensitive recording material according to any one of Items 1 to 16, wherein the support is neutral or acidic paper made from a pulp slurry containing pulp fiber, a filler, and a sizing agent.

Item 18: The heat-sensitive recording material according to any one of Items 1 to 17, wherein the heat-sensitive recording layer comprises as a sensitizer at least one member selected from the group consisting of stearamide, 2-naphthyl benzyl ether, di-p-chlorobenzyl oxalate, di-p-methylbenzyl oxalate, 1,2-di(3-methylphenoxy)ethane, 1,2-diphenoxyethane, and diphenylsulfone.

Item 19: The heat-sensitive recording material according to any one of Items 1 to 18, wherein the heat-sensitive recording layer comprises 1,2-di(3-methylphenoxy)ethane.

Item 20: The heat-sensitive recording material according to any one of Items 1 to 19, wherein the heat-sensitive recording layer is an outermost layer.

Item 21: A heat-sensitive recording material comprising a support, an undercoat layer, and a heat-sensitive recording layer, the undercoat layer comprising a pigment and a binder and formed on the support, the heat-sensitive recording layer comprising a leuco dye and a developer and formed on the undercoat layer, the support being neutral paper, and the developer comprising a sulfonamide compound represented by formula (1):

(1)

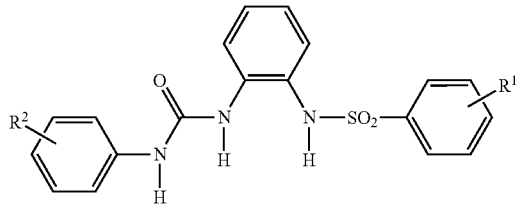

(wherein $R^1$ and $R^2$ may the same or different, and each represents a hydrogen atom and an alkyl group having 1 to 4 carbon atoms, an alkoxy group having 1 to 4 carbon atoms, or a halogen atom).

Item 22: The heat-sensitive recording material according to Item 21, wherein the sulfonamide compound represented by formula (1) is N-[2-(3-phenylureido)phenyl]benzenesulfonamide.

Item 23: The heat-sensitive recording material according to Item 21 or 22, wherein the neutral paper has a hot-water extraction pH (based on JIS P 8133) of 6.0 to 11.

Item 24: The heat-sensitive recording material according to any one of Items 21 to 23, wherein the sulfonamide compound represented by formula (1) is present in an amount of 0.5 to 5 parts by mass per part by mass of the leuco dye.

Item 25: The heat-sensitive recording material according to any one of Items 21 to 24, wherein the undercoat layer comprises hollow plastic particles as a pigment in an amount of 2 to 90 mass %, based on the total solids content of the undercoat layer.

Advantageous Effects of Invention

The heat-sensitive recording material according to the present invention has a high recording density, has excellent alcohol resistance or oil resistance in the recorded part, and also has excellent plasticizer resistance in the recorded part. Furthermore, the heat-sensitive recording material has excellent resistance to thermal background fogging in high-temperature environments.

The heat-sensitive recording material according to another embodiment of the present invention, which comprises neutral paper as a support, has excellent blank-paper preservability without decrease of color-developing ability during long-term storage as blank paper, and has high heat resistance in the unrecorded part, thus being free of background fogging during storage as blank paper.

DESCRIPTION OF EMBODIMENTS

1. The Heat-sensitive Recording Material According to the First Embodiment of the Present Invention The heat-sensitive recording material according to the first embodiment of the present invention comprises at least a heat-sensitive recording layer on a support, the heat-sensitive recording layer comprising a leuco dye and developers. The layer structure of the heat-sensitive recording material is not limited to a structure consisting of a support and a heat-sensitive recording layer, but includes a structure comprising an undercoat layer between the support and the heat-sensitive recording layer, a structure comprising a protective layer on the heat-sensitive recording layer, and a structure comprising a back layer on the support at the side opposite to the heat-sensitive recording layer.

Support

Although the support used in the heat-sensitive recording material according to the first embodiment of the present invention is not particularly limited, examples include neutral or acidic high-quality paper (neutral paper, acidic paper), synthetic paper, transparent or translucent plastic films, and white plastic films. Although the thickness of the support is not particularly limited, it is typically about 20 to 200 μm.

In particular, when the support of the heat-sensitive recording material according to the first embodiment of the present invention is neutral or acidic paper, it is preferable to use neutral or acidic paper made from a pulp slurry comprising pulp fiber, a filler, and a sizing agent. This can provide a heat-sensitive recording material that has excellent plasticizer resistance after blank-paper storage regardless of whether neutral or acidic paper is used, and that has excellent blank-paper preservability and potentially high recording density while having heat resistance in the background portion.

In general, when acidic paper is used, a color-developing substance contained in the heat-sensitive recording material reacts with acidic ions on the surface of the paper and is prone to cause background fogging during long-term storage. When neutral paper is used, color-developing ability decreases before recording, or colors fade after recording, which makes recorded images blurred, unclear, or, in some cases, almost illegible, during the storage of the heat-sensitive recording material, for example, within less than one year. Conventionally, the components of the heat-sensitive recording layer have been selected according to the type of paper used as a support. In contrast, in the present invention, due to a sulfonamide compound of formula (1) contained in the heat-sensitive recording layer, a heat-sensitive recording material can be provided that exhibits excellent plasticizer resistance after blank-paper storage regardless of whether neutral or acidic paper is used, and that has excellent blank-paper preservability and potentially high recording density while having high heat resistance in the background portion. Although the reason for this is not clear, it is presumed that during the storage of the heat-sensitive recording material, a usual developer forms a salt with an alkaline filler contained in neutral paper and thus results in reduced performance of the developer, whereas the sulfonamide compound represented by formula (1) does not cause morphological changes regardless of whether neutral or acid paper is used.

The type of neutral paper and method for producing neutral paper are not particularly limited. The neutral paper can be generally made from a pulp slurry comprising pulp fiber with a filler such as calcium carbonate; a sizing agent such as an alkyl ketene dimer (AKD) or anhydrous alkenyl succinic acid (ASA); and a Fixing agent such as polyamide, acrylamide, or cationic starch. Such neutral paper preferably has a hot-water extraction pH (according to JIS P 8133) of about 6.0 to 11, more preferably about 6.5 to 10, and even more preferably about 7.5 to 10. When the pH of the neutral paper is adjusted to 6.0 or higher, background fogging after blank-paper storage can be effectively inhibited. On the other hand, when the pH of the neutral paper is adjusted to 11 or lower, reduction in color-developing ability after blank-paper storage can be effectively inhibited, and coagulation of the pulp slurry itself can also be inhibited. If necessary, aluminum sulfate may be used to adjust the pH within the range of not lower than pH of 6.0 to enhance paper-making properties.

The type of acidic paper and the method for making acidic paper are not particularly limited. The acidic paper can be generally made from a pulp slurry comprising pulp fiber with a filler, such as kaolin, talc, or chlorite; a sizing agent, such as reinforced rosin soap, reinforced rosin emulsion, and like rosin-based sizing agents, alkenyl succinic acid soap, and like synthetic sizing agents; aluminium sulfate; etc. The acidic paper preferably has a hot-water extraction pH (according to JIS P 8133) of 2 or more in view of increasing the resistance to background fogging and preventing deterioration of the support. The acidic paper preferably has a hot-water extraction pH of not higher than 6, more preferably a pH of about 2 to 6, and even more preferably a pH of about 2 to 5.7, in view of securing the rosin-based sizing agent.

The type of pulp fiber, manufacturing method, etc. used in the present invention are not particularly limited. Examples of pulp include softwood pulp, hardwood pulp, and like chemical pulp obtained by KP, SP, AP, and like methods, various types of high-yield pulp, and waste paper pulp.

In the pulp slurry, internal auxiliary agents for papermaking, such as dyes, fluorescent whitening agents, pH adjusting agents, antifoaming agents, pitch control agents, and slime control agents, may be suitably added as necessary. In the size press, starch, etc., may be applied. As the paper-making machine, a Fourdrinier paper machine, twin-wire paper machine, cylinder paper machine, Yankee dryer paper machine, etc., can be suitably used.

Heat-sensitive Recording Layer

The heat-sensitive recording layer of the heat-sensitive recording material according to the first embodiment of the present invention may comprise any of various colorless or pale-colored known leuco dyes. Specific examples of such leuco dyes include dyes capable of developing blue color, such as 3,3-bis(p-dimethylaminophenyl)-6-dimethylaminophthalide, 3-(4-diethylamino-2-methylphenyl)-3-(4-dimethylaminophenyl)-6-dimethylaminophthalide, and fluoran; dyes capable of developing green color, such as 3-(N-ethyl-N-p-tolyl)amino-7-N-methylanilinofluoran, 3-diethylamino-7-anilinofluoran, and 3-diethylamino-7-dibenzylaminofluoran; dyes capable of developing red color, such as 3,6-bis(diethylamino)fluoran-γ-anilinolactam, 3-cyclohexylamino-6-chlorofluoran, 3-diethylamino-6-methyl-7-chlorofluoran, and 3-diethylamino-7-chlorofluoran; dyes capable of developing black color, such as 3-(N-ethyl-N-isoamyl)amino-6-methyl-7-anilinofluoran, 3-(N-methyl-N-cyclohexyl)amino-6-methyl-7-anilinofluoran, 3-diethylamino-6-methyl-7-anilinofluoran, 3-di(n-butyl)amino-6-methyl-7-anilinofluoran, 3-di(n-pentyl)amino-6-methyl-7-anilinofluoran, 3-diethylamino-7-(0-chlorophenylamino)fluoran, 3-(N-ethyl-p-toluidino)-6-methyl-7-anilinofluoran, 3-(N-ethyl-p-toluidino)-6-methyl-7-(p-toluidino)fluoran, 3-(N-ethyl-N-tetrahydrofurfurylamino)-6-methyl-7-anilinofluoran, 3-diethylamino-6-chloro-7-anilinofluoran, 3-dimethylamino-6-methyl-7-anilinofluoran, 3-pyrrolidino-6-methyl-7-anilinofluoran, 3-piperidino-6-methyl-7-anilinofluoran, 2,2-bis{(4-[6'-(N-cyclohexyl-N-methylamino)-3'-methylspiro[phthalide-3,9'-xanthen-2'-ylamino]phenyl)}propane, and 3-diethylamino-7-(3'-trifluoromethylphenyl)aminofluoran; and dyes having absorption wavelengths in the near infrared region, such as 3,3-bis[1-(4-methoxyphenyl)-1-(4-dimethylaminophenyl)ethylen-2-yl]-4,5,6,7-tetrachlorophthalide, 3,3-bis[1-(4-methoxyphenyl)-1-(4-pyrrolidinophenyl)ethylen-2-yl]-4,5,6,7-tetrachlorophthalide, 3,3-bis[1-(4-methoxyphenyl)-1-(4-dimethylaminophenyl)ethylen-2-yl]-4,5,6,7-tetrachlorophthalide, 3-p-(p-dimethylaminoanilino)anilino-6-methyl-7-chlorofluoran, 3-p-(p-chloroanilino)anilino-6-methyl-7-chlorofluoran, and 3,6-bis(dimethylamino)fluorene-9-spiro-3'-(6'-dimethylamino)phthalide. Usable lueco dyes are, of course, not limited to the compounds mentioned above, and two or more of such compounds may be used in combination as necessary. Among these, 3-di(n-butyl)amino-6-methyl-7-anilinofluoran, 3-di(n-pentyl)amino-6-methyl-7-anilinofluoran, and 3-(N-ethyl-N-isoamylamino)-6-methyl-7-anilinofluoran have excellent color-developing sensitivity and print preservability, and are thus preferably used. The amount of the leuco dye is about 5 to 25 mass %, and preferably about 7 to 20 mass %, based on the total solids content of the heat-sensitive recording layer. 5 mass % or more of the leuco dye can enhance color-developing ability and thus improve printing density, whereas 25 mass % or less of the leuco dye can enhance heat resistance.

The heat-sensitive recording layer of the heat-sensitive recording material according to the first embodiment of the present invention comprises a sulfonamide compound represented by formula (1) (hereinafter also referred to as a "specific sulfonamide compound") as developers, and further comprises a urea-urethane compound represented by formula (2) (hereinafter also referred to as a "specific urea-urethane compound"), and/or a diphenylsulfone-crosslinked compound represented by formula (3) (hereinafter also referred to as a "specific diphenylsulfone-crosslinked compound") as a developer. This feature provides high recording density and excellent alcohol resistance and oil resistance of the recorded part, as well as excellent plasticizer resistance. Excellent resistance to thermal background fogging in high-temperature environments is also provided.

The specific diphenylsulfone-crosslinked compound may be used as a mixture of compounds represented by formula (3), wherein n is an integer of 1 to 6, or such diphenylsulfone-crosslinked compounds may be used alone or in a combination of two or more.

Using a specific diphenylsulfone-crosslinked compound and a specific sulfonamide compound as developers can enhance plasticizer resistance after blank-paper storage in addition to providing the above effects.

Further, using a specific sulfonamide compound provides high recording density, as well as imparting high heat resistance to unrecorded parts and imparting plasticizer resistance to recorded parts, and can achieve excellent blank-paper preservability when neutral paper is used as a support.

Furthermore, using a specific diphenylsulfone-crosslinked compound, a specific urea-urethane compound, and a specific sulfonamide compound provides high recording density and imparts good oil resistance and plasticizer resistance to recorded parts, and provides excellent resistance to thermal background fogging in high-temperature environments, as well as excellent sticking resistance and head residue resistance. Further, the plasticizer resistance after blank-paper storage can also be improved.

Examples of the specific sulfonamide compound include N-[2-(3-phenylureido)phenyl]benzenesulfonamide, N-[2-(3-phenylureido)phenyl]-p-toluenesulfonamide, N-[2-(3-phenylureido)phenyl]-o-toluenesulfonamide, and N-[2-(3-(4-methylphenyl)ureido)phenyl]benzenesulfonamide. Among these, N-[2-(3-phenylureido)phenyl]benzenesulfonamide is preferable in view of high sensitivity, print preservability, and ease of synthesis.

In view of enhancing the recording density and plasticizer resistance, the amount of the specific sulfonamide compound in the heat-sensitive recording layer of the heat-sensitive recording material according to the first embodiment of the present invention is preferably about 0.5 to 5 parts by mass, more preferably about 0.8 to 4 parts by mass, even more preferably about 1 to 4 parts by mass, and particularly preferably about 1.2 to 3.5 parts by mass, about 1.2 to 3.0 parts by mass, or about 1.2 to 2.2 parts by mass, per part by mass of the leuco dye. When the amount of the specific sulfonamide compound is 0.5 parts by mass or more per part by mass of the leuco dye, sufficient recording density can be provided, whereas when its amount is 5 parts by mass or less, background fogging in high-temperature environments can be effectively inhibited.

The amount of the specific sulfonamide compound in the heat-sensitive recording layer of the heat-sensitive recording material according to the first embodiment of the present invention, which comprises a specific diphenylsulfone-crosslinked compound, a specific urea-urethane compound, and a specific sulfonamide compound as mentioned above, is preferably about 0.5 to 5 parts by mass, more preferably about 0.8 to 3 parts by mass, even more preferably about 0.9 to 2.5 parts by mass, particularly preferably about 1.0 to 2.3 parts by mass, and most preferably about 1.0 to 2.1 parts by mass, per part by mass of the leuco dye, in view of enhancing the recording density and plasticizer resistance. When the amount of the specific sulfonamide compound is 0.5 parts by mass or more, recording density and resistance to thermal background fogging can be improved. When the amount of the specific sulfonamide compound is 5 parts by mass or less, oil resistance and plasticizer resistance can be improved.

Examples of the specific urea-urethane compound include 4,4'-bis[(4-methyl-3-phenoxycarbonylaminophenyl)ureido]

diphenylsulfone, 4,4'-bis[(2-methyl-5-phenoxycarbonylaminophenyl)ureido]diphenylsulfone, and 4-(2-methyl-3-phenoxycarbonylaminophenyl)ureido-4'-(4-methyl-5-phenoxycarbonylaminophenyl)ureidodiphenylsulfone. Such specific urea-urethane compounds can be used singly or in a combination of two or more.

Using 4,4'-bis[(4-methyl-3-phenoxycarbonylaminophenyl)ureido]diphenylsulfone as the specific urea-urethane compound is preferable in view of improving the record preservability against oils, plasticizers, alcohols, etc.

A compound obtained by heat-treating a specific urea-urethane compound in the presence of a basic inorganic pigment is preferably used as a developer. For example, when a coating composition for heat-sensitive recording layers comprising 4,4'-bis[(4-methyl-3-phenoxycarbonylaminophenyl)ureido]diphenylsulfone is used to form a heat-sensitive recording layer, the 4,4'-bis[(4-methyl-3-phenoxycarbonylaminophenyl)ureido]diphenylsulfone may be heat-treated in advance at about 50 to 90° C., and preferably about 60 to 80° C., in the presence of a basic inorganic pigment in the same liquid to form a dispersion and may be incorporated as the heat-treated dispersion into the coating composition for heat-sensitive recording layers. This can inhibit unnecessary color development (background fogging) after the coating composition for heat-sensitive recording layers is applied and dried to form a heat-sensitive recording layer. The treatment time may be suitably adjusted according to the heating temperature. About 2 to 24 hours of heat-treatment is usually preferable. The dispersion before being heat-treated can be obtained by dispersing 4,4'-bis[(4-methyl-3-phenoxycarbonylaminophenyl)ureido]diphenylsulfone to a specific particle size and then mixing a basic inorganic pigment into the dispersion or by mixing 4,4'-bis[(4-methyl-3-phenoxycarbonylaminophenyl)ureido]diphenylsulfone with a basic inorganic pigment and then dispersing the mixture to a specific particle size.

The basic inorganic pigment is preferably at least one member selected from the group consisting of magnesium compounds, aluminium compounds, calcium compounds, titanium compounds, magnesium silicate, magnesium phosphate, and talc. Among these, magnesium silicate, magnesium phosphate, and talc are preferably used in view of stability of the coating composition or coating suitability.

The amount of the basic inorganic pigment used is not particularly limited. The basic inorganic pigment is used in an amount of about 0.5 to 20 parts by mass, preferably about 1 to 10 parts by mass, per 100 parts by mass of the specific urea-urethane compound.

The specific sulfonamide compound and/or the specific diphenylsulfone-crosslinked compound has high recording density, causes little background fogging in high-temperature environments, but has a problem of low plasticizer resistance in the recorded part. However, the use of a specific urea-urethane compound with either or both of these compounds can ensure excellent recording density as well as high oil resistance, plasticizer resistance, and alcohol resistance in the recorded part. Furthermore, although a combination of different developers generally greatly worsens background fogging, a combination of a specific urea-urethane compound with a specific sulfonamide compound and/or a specific diphenylsulfone-crosslinked compound according to the present invention produces synergistic effects that do not worsen background fogging but cause no background fogging even in a high-temperature environment of 80° C.

The amount of specific urea-urethane compound in the heat-sensitive recording layer of the heat-sensitive recording material according to the first embodiment of the present invention is preferably about 0.03 to 2.5 parts by mass, and more preferably about 0.05 to 2.0 parts, per part by mass of the specific sulfonamide compound. When the amount of the specific urea-urethane compound is 0.03 parts by mass or more, sufficient plasticizer resistance in the recorded part is obtained. On the other hand, when the amount of the specific urea-urethane compound is 2.5 parts by mass or less, background fogging at high-temperature environments can be improved.

When the heat-sensitive recording layer of the heat-sensitive recording material according to the first embodiment of the present invention comprises the specific urea-urethane compound, specific sulfonamide compound, and specific diphenylsulfone-crosslinked compound, the amount of the specific urea-urethane compound in the heat-sensitive recording layer is preferably about 0.2 to 5 parts by mass, more preferably about 0.3 to 3 parts by mass, even more preferably 0.5 to 2 parts by mass, and particularly preferably 0.5 to 1.5 parts by mass, per part by mass of the specific diphenylsulfone-crosslinked compound. When the amount of the specific urea-urethane compound is in the range of 0.2 to 5 parts by mass, the above effects can be effectively exhibited.

Although using a specific diphenylsulfone-crosslinked compound ensures excellent recording density, as well as high oil resistance and plasticizer resistance of the recorded part, decrease in sticking resistance and head residue resistance is problematic. Furthermore, in low-energy printing assumed to be used for recent high-speed printers and battery-operated handheld device printers, using a specific urea-urethane compound results in insufficient oil resistance and plasticizer resistance due to low color-developing sensitivity of the urea-urethane compound. If the amount of the specific urea-urethane compound is increased to enhance color-developing density, decrease in sticking resistance and head residue resistance becomes problematic. In contrast, a combination of a specific diphenyl sulfone compound and a specific urea-urethane compound can reduce the viscosity of a molten component and can also ameliorate the head residue and sticking. Furthermore, since the specific diphenyl sulfone compound and the specific urea-urethane compound synergistically enhance sensitivity, color-developing sensitivity sufficient for practical use can be obtained and excellent oil resistance and plasticizer resistance can be exhibited. Furthermore, although a combination of several types of developers generally significantly worsens background fogging, a combination of the specific diphenylsulfone-crosslinked compound, urea-urethane compound, and specific sulfonamide compound according to the present invention produces excellent synergistic effects that do not worsen background fogging but cause no background fogging even in a high-temperature environment of 80° C.

The amount of the specific urea-urethane compound in the heat-sensitive recording layer of the heat-sensitive recording material according to the first embodiment of the present invention is preferably 0.1 to 3.0 parts by mass, more preferably 0.2 to 2.5 parts by mass, and even more preferably 0.5 to 2.0 parts by mass, per part by mass of the leuco dye. The specific urea-urethane compound can be used in an amount adjusted within the above range of the amount relative to N-[2-(3-phenylureido)phenyl]benzenesulfonamide.

The heat-sensitive recording layer of the heat-sensitive recording material according to the first embodiment of the present invention comprises a specific urea-urethane compound as a developer, and further comprises a specific sulfonamide compound and/or a specific diphenylsulfone-crosslinked compound as developers. Various known materials can optionally be used with these as long as the effects of the present invention are not impaired. Examples of such materials include activated clay, attapulgite, colloidal silica, aluminum silicate, and like inorganic acid materials; 4,4'-isopropylidenediphenol, 1,1-bis(4-hydroxyphenyl)-1-phenylethane, 1,1-bis(4-hydroxyphenyl)cyclohexane, 2,2-bis(4-hydroxyphenyl)-4-methylpentane, 2,4'-dihydroxydiphenylsulfone, 4,4'-dihydroxydiphenylsulfide, hydroquinonemonobenzyl ether, 4,4'-bis(3-(tosyl)ureido)diphenylmethane, 4,4'-(3-(tosyl)ureido)diphenylether, 4-hydroxy-4'-benzyloxydiphenylsulfone, 4-benzylhydroxybenzoate, 4,4'-dihydroxydiphenylsulfone, 4-hydroxy-4'-isopropoxydiphenylsulfone, bis(3-allyl-4-hydroxyphenyl) sulfone, 4-hydroxy-4'-methyldiphenylsulfone, 4-hydroxyphenyl-4'-benzyloxyphenylsulfone, 4-allyloxy-4'-hydroxydiphenylsulfone, 3,4-dihydroxyphenyl-4'-methylphenylsulfone, and like phenolic compounds; N,N'-di-m-chlorophenylthiourea, and like thiourea compounds; N-(p-toluenesulfonyl)carbamoyl acid p-cumylphenyl ester, N-(p-toluenesulfonyl)carbamoyl acid p-benzyloxyphenyl ester, N-(o-toluoyl)-p-toluenesulfonylamide, and like organic compounds having an —$SO_2$NH— bond in a molecule; p-chlorobenzoic acid, 4-[2-(p-methoxyphenoxy)ethyloxy] salicylic acid, 4-[3-(p-tolylsulfonyl)propyloxy]salicylic acid, 5-[p-(2-p-methoxyphenoxyethoxy)cumyl]salicylic acid, and like aromatic carboxylic acids; and salts of these aromatic carboxylic acids with polyvalent metals such as zinc, magnesium, aluminum, calcium, titanium, manganese, tin, and nickel; antipyrin complex of zinc thiocyanate, composite zinc salts of terephthalaldehydic acid with another aromatic carboxylic acid, and like organic acidic materials; and 4,4'-bis(3-tosylureido)diphenylmethane, 1,5-(3-oxopentylene)-bis(3-(3'-(p-toluenesulfonyl)ureido)benzoate, 1-(4-butoxycarbonylphenyl)-3-tosylurea, N-p-toluenesulfonyl-N'-3-(p-toluensulfonyloxy)phenylurea, N-(p-toluenesulfonyl)-N'-phenylurea, N-(p-toluenesulfonyl)-N'-p-tolylurea, 4,4'-bis(3-(tosyl)ureido)diphenyl ether, 4,4'-bis(3-tosylureido)diphenylsulfone, and like sulfonylurea compounds.

The amount of the specific diphenylsulfone-crosslinked compound in the heat-sensitive recording layer of the heat-sensitive recording material according to the first embodiment of the present invention is preferably about 0.1 to 2.5 parts by mass, more preferably about 0.2 to 2 parts by mass, even more preferably about 0.5 to 1.6 parts by mass, and particularly preferably about 0.9 to 1.4 parts by mass, per part by mass of the specific sulfonamide compound. 0.1 parts by mass or more of the specific diphenylsulfone-crosslinked compound can impart sufficient plasticizer resistance to the recorded part. On the other hand, 2.5 parts by mass or less of the specific diphenylsulfone-crosslinked compound can improve resistance to thermal background fogging in high-temperature environments.

In view of enhancing recording density and plasticizer resistance, the amount of the specific diphenylsulfone-crosslinked compound in the heat-sensitive recording layer of the heat-sensitive recording material according to the first embodiment of the present invention is preferably about 0.2 to 3.0 parts by mass, more preferably about 0.4 to 2 parts by mass, even more preferably about 0.4 to 1.8 parts by mass, per part by mass of the leuco dye. The diphenylsulfone-crosslinked compound can be used in an amount adjusted within the aforementioned range of the amount relative to the specific sulfonamide compound.

The total amount of the combination of the specific diphenylsulfone-crosslinked compound and the specific urea-urethane compound in the heat-sensitive recording layer of the heat-sensitive recording material according to the first embodiment of the present invention may be preferably about 0.2 to 3 parts by mass, more preferably about 0.3 to 2.5 parts by mass, even more preferably about 0.4 to 2.5 parts by mass, particularly preferably about 0.5 to 2 parts by mass, and most preferably about 0.9 to 1.5 parts by mass, per part by mass of the specific sulfonamide compound. 0.2 parts by mass or more of the specific sulfonamide compound imparts sufficient oil resistance and plasticizer resistance to the recorded part. On the other hand, 3 parts by mass or less of the specific sulfonamide compound provides enhanced recording density and inhibits background fogging in high-temperature environments.

The heat-sensitive recording layer of the heat-sensitive recording material according to the first embodiment of the present invention preferably contains each of the specific diphenylsulfone-crosslinked compound and the specific urea-urethane compound in an amount of 2.5 mass % or more, more preferably 4.5 mass % or more, and even more preferably about 9 mass % or more, and preferably contains the specific sulfonamide compound in an amount of about 15 to 90 mass %, and more preferably about 25 to 75 mass %, based on the total amount of the developer. Preferably, the specific diphenylsulfone-crosslinked compound and the specific urea-urethane compound are each present in an amount of less than 50 mass %. When these specific compounds are used in amounts adjusted within the above ranges and the total amount of these specific developers is 100 mass %, the effects of the present invention can be fully provided. Therefore, the above proportions are preferable.

The total amount of the specific diphenylsulfone-crosslinked compound and the specific urea-urethane compound in the heat-sensitive recording layer of the heat-sensitive recording material according to the first embodiment of the present invention is preferably about 0.2 to 3.5 parts by mass, more preferably about 0.5 to 3 parts by mass, even more preferably about 0.7 to 2.5 parts by mass, particularly preferably about 0.9 to 2.3 parts by mass, and most preferably about 1 to 2.2 parts by mass, per part by mass of the leuco dye. When the total amount is 0.2 parts by mass or more, oil resistance and plasticizer resistance can be improved. When the total amount is 3.5 parts by mass or less, recording density and resistance to thermal background fogging can be improved. The specific diphenylsulfone-crosslinked compound and the specific urea-urethane compound can be used in a combined amount adjusted within the above range of the amount relative to the specific sulfonamide compound.

The heat-sensitive recording layer of the heat-sensitive recording material according to the first embodiment of the present invention may comprise a preservability-improving agent. This can enhance the preservability of the recorded part. Examples of preservability-improving agents include 2,2'-methylenebis(4-methyl-6-tert-butylphenol), 2,2'-methylenebis(4-ethyl-6-tert-butylphenol), 2,2'-ethylidenebis(4,6-di-tert-butylphenol), 4,4'-thiobis(2-methyl-6-tert-butylphenol), 4,4'-butylidenebis(6-tert-butyl-m-cresol), 1-[α-methyl-α-(4'-hydroxyphenyl)ethyl]-4-[α',α'-bis(4'-hydroxyphenyl) ethyl]benzene, 1,1,3-tris(2-methyl-4-hydroxy-5-cyclohexylphenyl)butane, 1,1,3-tris(2-methyl-4-hydroxy-5-tert-buthylphenyl)butane, tris(2,6-dimethyl-4-tert-butyl-3-hydroxybenzyl)isocyanurate, 4,4'-thiobis(3-methylphenol), 4,4'-dihydroxy-3,3',5,5'-tetrabromodiphenylsulfone, 4,4'-dihydroxy-3,3',5,5'-tetramethyldiphenylsulfone, 2,2-bis(4-hydroxy-3,5-dibromophenyl)propane, 2,2-bis(4-hydroxy-3,5-dichlorophenyl)propane, 2,2-bis(4-hydroxy-3,5-dimethylphenyl)propane, and like hindered phenol compounds; 1,4-diglycidyloxybenzene, 4,4'-diglycidyloxydiphenylsulfone, 4-benzyloxy-4'-(2-methylglycidyloxy)diphenylsulfone, diglycidyl terephthalate, cresol novolac epoxy resin, phenol novolac epoxy resin, bisphenol A epoxy resin, and like epoxy compounds; and N,N'-di-2-naphthyl-p-phenylenediamine, salts of sodium or polyvalent metal of 2,2'-methylenebis(4,6-di-tert-butylphenyl)phosphate, and bis(4-ethyleneiminocarbonylaminophenyl)methane. Such a preservability-improving agent may be used in an amount effective to improve preservability. The preservability-improving agent is typically used preferably in an amount of about 1 to 30 mass %, more preferably about 5 to 20 mass %, based on the total solids content of the heat-sensitive recording layer.

The coating composition for forming a heat-sensitive recording layer typically comprises at least one of various resins as a binder. Examples of such binders include starches, hydroxyethyl cellulose, methyl cellulose, carboxymethyl cellulose, gelatin, casein, gum arabic, polyvinyl alcohols, carboxy-modified polyvinyl alcohols, acetoacetyl-modified polyvinyl alcohols, diacetone-modified polyvinyl alcohol, silicon-modified polyvinyl alcohols, carboxy-modified polyvinyl alcohol, sulfone-modified polyvinyl alcohol, diisobutylene-maleic anhydride copolymer salts, styrene-maleic anhydride copolymer salts, ethylene-acrylic acid copolymer salts, styrene-acrylic acid copolymer salts, styrene-butadiene copolymer, urea resins, melamine resins, amide resins, and polyurethane resins. The coating composition for heat-sensitive recording layers preferably comprises at least one of such resins in an amount of about 5 to 50 mass %, and more preferably about 10 to 40 mass %, based on a total solids content of the heat-sensitive recording layer. When the medium of the coating composition for heat-sensitive recording layers is water, hydrophobic resins may be used in the form of latexes.

In the heat-sensitive recording material according to the first embodiment of the present invention, the heat-sensitive recording layer may further comprise a sensitizer, and other various auxiliary agents, in addition to the specific developers, leuco dye, and binder.

Incorporating a sensitizer in the heat-sensitive recording layer according to the first embodiment of the present invention can enhance recording sensitivity. Examples of sensitizers include stearamide, methoxycarbonyl-N-benzamidestearate, N-benzoyl stearamide, N-eicosanamide, ethylene-bis-stearamide, behenamide, methylene-bis-stearamide, N-methylol stearamide, dibenzyl terephthate, dimethyl terephthalate, dioctyl terephthate, benzyl p-benzyloxy benzoate, phenyl 1-hydroxy-2-naphthoate, 2-naphthyl benzyl ether, m-terphenyl, p-benzyl biphenyl, di-p-chlorobenzyl oxalate, di-p-methylbenzyl oxalate, dibenzyl oxalate, p-tolylbiphenyl ether, di(p-methoxyphenoxyethyl) ether, 1,2-di(3-methylphenoxy)ethane, 1,2-di(4-methylphenoxy)ethane, 1,2-di(4-methoxyphenoxy)ethane, 1,2-di(4-chlorophenoxy)ethane, 1,2-diphenoxyethane, 1-(4-methoxyphenoxy)-2-(3-methylphenoxyl)ethane, p-methylthiophenylbenzyl ether, 1,4-di(phenylthio)butane, p-acetotoluidide, p-acetophenetidide, N-acetoacetyl-p-toluidine, di(β-biphenylethoxy)benzene, p-di(vinyloxyethoxy) benzene, 1-isopropylphenyl-2-phenylethane, and diphenylsulfone. Such sensitizers can be used in combination as long as the effects of the present invention are not impaired. Among these, stearamide, 2-naphthyl benzyl ether, di-p-chlorobenzyl oxalate, di-p-methylbenzyl oxalate, 1,2-di(3-methylphenoxy)ethane, 1,2-diphenoxyethane, and diphenylsulfone have an excellent sensitizing effects and are thus preferably used.

The sensitizer may be used in an amount effective for increasing sensitivity. The sensitizer is typically used in an amount of preferably about 1 to 40 mass %, more preferably about 2 to 40 mass %, even more preferably about 5 to 25 mass %, and still more preferably about 8 to 20 mass %, based on the total solids content of the heat-sensitive recording layer.

In view of effectively enhancing the recording sensitivity and suppressing the background fogging resistance, the amount of the sensitizer is preferably about 0.6 to 2.5 parts by mass, and more preferably about 0.6 to 1.5 parts by mass, per part by mass of N-[2-(3-phenylureido)phenyl]benzenesulfonamide.

Examples of auxiliary agents include sodium dioctyl sulfosuccinate, sodium dodecylbenzene sulfonate, sodium lauryl alcohol sulfate, metal salts of fatty acids, and like dispersants; zinc stearate, calcium stearate, polyethylene wax, carnauba wax, paraffin wax, ester wax, and like waxes; adipic dihydrazide and like hydrazide compounds, glyoxal, boric acid, glyoxylic acid salt, dialdehyde starch, methylolurea, epoxy compounds, and like water-resistance-imparting agents; antifoaming agents (such as glycerol ester emulsion antifoaming agents, which are natural oil antifoaming agents), colorant dyes, fluorescent dyes, and pigments.

In the heat-sensitive recording material according to the first embodiment of the present invention, the heat-sensitive recording layer may contain fine pigment particles having high whiteness and an average particle diameter of 10 μm or less to enhance the whiteness of the heat-sensitive recording layer and improve the uniformity of images. Examples of such fine pigment particles include calcium carbonate, magnesium carbonate, kaoline, clay, talc, calcined kaolin, calcined clay, (amorphous) silica, diatomaceous earth, synthetic aluminum silicate, zinc oxide, titanium oxide, aluminium hydroxide, barium sulfate, surface-treated calcium carbonate, silica, and like inorganic pigments, urea-formalin resin, styrene methacrylic acid copolymer resin, polystyrene resin, raw starch particles, and like organic pigments. The pigment is preferably used in an amount not to reduce the color-developing density, i.e., preferably 50 mass % or less, and more preferably about 30 mass % or less, based on the total solids content of the heat-sensitive recording layer.

The heat-sensitive recording layer in the heat-sensitive recording material according to the first embodiment of the present invention can be formed by applying the coating composition for heat-sensitive recording layers to a support and drying. For example, a leuco dye and specific developers, optionally with a sensitizer, a preservability-improving agent, etc., are dispersed, either together or separately, into finely divided particles with an average particle diameter of about 2 or less using water as a dispersion medium by using a mixing and pulverizing equipment, such as a ball mill, an attritor, or a sand mill. A coating composition for heat-sensitive recording layers prepared by optionally mixing a pigment, a binder, auxiliary agents, etc., into the finely disperse dispersion as necessary is applied to a support to a dry coat weight of preferably 2 to 12 g/m$^2$, and more preferably about 3 to 10 g/m$^2$, and is then dried to form a heat-sensitive recording layer.

Undercoat Layer

The heat-sensitive recording material according to the first embodiment of the present invention preferably comprises an undercoat layer comprising hollow plastic particles and formed between the support and the heat-sensitive recording layer. This can further enhance recording sensitivity. The hollow plastic particles remaining on the support allow for the formation of a uniform undercoat layer so that the coating layer formed on the undercoat layer can have a uniform thickness and barrier properties are enhanced. This can prevent the developers from contacting a plasticizer or an alkaline filler contained in the neutral paper, thus inhibiting decrease in color-developing ability.

Examples of usable hollow plastic particles include known fine hollow particles having a hollow ratio of about 50 to 99% and comprising acrylic resin, styrene resin, vinylidene chloride resin, or the like as a film material. The "hollow ratio" used herein is a value obtained according to the following formula: $(d/D)\times100$. In the formula, d represents the inner diameter of an organic hollow particle, and D represents the outer diameter of the organic hollow particle. The hollow plastic particles preferably have an average particle diameter of about 0.5 to 10 μm, more preferably about 1 to 3 μm. By adjusting the average particle diameter to 10 μm or less, deficiencies such as streaks and scratches do not occur during application of an undercoat layer coating composition by blade coating, and good coating suitability can be obtained. In terms of quality, this enhances the smoothness of the undercoat layer surface and thus can enhance application uniformity of the coating composition for heat-sensitive recording layers and enables curtain coating, and enhance the barrier properties of the optionally provided protective layer.

The amount of hollow plastic particles used can be selected from a broad range, but is typically preferably about 2 to 90 mass %, based on the total solids content of the undercoat layer. In view of improving color-developing properties and enhancing barrier properties, the lower limit of the amount of the hollow plastic particles is more preferably 5 mass % or more, and even more preferably 10 mass % or more. On the other hand, in view of inhibiting adhesion of the residue to a thermal head, the upper limit of the amount is more preferably 80 mass % or less, even more preferably 70 mass % or less, and particularly preferably 60 mass % or less, and most preferably 50 mass % or less.

The undercoat layer in the heat-sensitive recording material according to the first embodiment of the present invention may comprise an oil-absorbing pigment with an oil absorption of 70 ml/100 g or more, and particularly about 80 to 150 ml/100 g, and/or thermal expansion particles. In particular, using an oil-absorbing pigment can enhance the effect of inhibiting the adhesion of the residue to a thermal head and is thus preferable. The oil absorption referred to herein is a value determined in accordance with JIS K 5101.

The oil-absorbing pigment may be any of various types of oil-absorbing pigments. Specific examples include inorganic pigments such as calcined kaolin, amorphous silica, light calcium carbonate, and talc. Such oil-absorbing pigments preferably have an average primary particle diameter of about 0.01 to 5 μm, and particularly about 0.02 to 3 μm. The amount of the oil-absorbing pigment used can be selected from a broad range, but is typically preferably about 2 to 95 mass %, and more preferably about 5 to 90 mass %, based on the total solids content of the undercoat layer.

When an oil-absorbing inorganic pigment is used with hollow plastic particles, each of the pigment and the particles is preferably used in the range mentioned above, and the total amount of the pigment and particles is preferably about 5 to 90 mass %, more preferably about 10 to 90 mass %, and even more preferably about 10 to 80 mass %, based on the total solids content of the undercoat layer.

The undercoat layer is generally formed by preparing an undercoat layer coating composition by mixing and stirring hollow plastic particles, an oil-absorbing pigment, a binder, auxiliary agents, etc., using water as a medium, applying the thus prepared coating composition to a support, and drying. The amount of the undercoat layer coating composition is not particularly limited, but the coating composition is preferably applied to a dry coat weight of 3 to 20 $g/m^2$, and more preferably about 5 to 12 $g/m^2$.

The binder to be used can be suitably selected from binders that can be used in the heat-sensitive recording layer. In view of increasing the coating film strength, oxidized starch, starch-vinyl acetate graft copolymers, polyvinyl alcohols, styrene-butadiene copolymer latexes, and the like are particularly preferable. The amount of the binder to be used can be selected from a broad range, but is typically preferably about 5 to 30 mass %, and more preferably about 10 to 20 mass %, based on the total solids content of the undercoat layer.

In the heat-sensitive recording material according to the first embodiment of the present invention, application of the undercoat layer by blade coating can enhance the surface smoothness of the undercoat layer in terms of quality, and thereby enhance the application uniformity of the coating composition for heat-sensitive recording layers and enable curtain coating, thus enhancing the barrier properties of a protective layer optionally provided. The amount of hollow plastic particles used can be selected from a broad range, but is typically preferably about 2to 90 mass %, based on the total solids content of the undercoat layer. In view of improving color-developing properties and enhancing barrier properties, the low limit of the amount of the hollow plastic particles is more preferably 5 mass % or more, and even more preferably 10 mass % or more. On the other hand, in view of inhibiting adhesion of the residue to a thermal head, the upper limit of the amount of the hollow plastic particles is more preferably 80 mass % or less, even more preferably 70 mass % or less, and particularly preferably 60 mass % or less, and most preferably 50 mass % or less.

Protective Layer

The heat-sensitive recording material according to the first embodiment of the present invention may comprise a protective layer on a heat-sensitive recording layer in order to improve the recorded-image preservability against chemicals, such as plasticizers and oils, or to improve the recording suitability.

The protective layer of the heat-sensitive recording material according to the first embodiment of the present invention may be formed, for example, by mixing and stirring a binder, a water-resistance-imparting agent, a pigment, an auxiliary agent, etc., using water as a dispersion medium to prepare a protective layer coating composition, applying the coating composition to the heat-sensitive recording layer to a dry coating weight of preferably about 0.5 to 15 $g/m^2$, and more preferably to about 1.0 to 8 $g/m^2$, and is dried.

Examples of usable binders include starch, hydroxyethyl cellulose, methyl cellulose, carboxymethyl cellulose, gelatin, casein, gum arabic, polyvinyl alcohol, carboxyl-modified polyvinyl alcohol, acetacetyl-modified polyvinyl alcohol, diacetone-modified polyvinyl alcohol, silicon-modified polyvinyl alcohol, and ionomeric urethane resin latex.

The protective layer in the heat-sensitive recording material according to the first embodiment of the present invention may be formed by using a binder and one or more various auxiliary agents without using any pigment, or using a binder and a pigment together. Examples of pigments that can be contained in the protective layer include pigments such as kaoline, aluminium hydroxide, light calcium carbonate, and silica particles. Among these, kaolin and aluminum hydroxide are preferable in view of less decrease in barrier properties against plasticizers, oils, etc., and less reduction in recording density. When a binder and a pigment are used together, the amount of the binder used is not particularly limited and can be suitably selected from a broad range. Generally, the amount of the binder is preferably about 1 to 95 mass %, and more preferably about 2to 80 mass %, based on the total solids content of the protective layer. The amount of the pigment used is not particularly limited and can be suitably selected from a broad range. It is usually preferable that the amount of the binder be about 1to 95 mass %, and more preferably about 2to 90 mass %, based on the total solids content of the protective layer.

The protective layer coating composition may further comprise various auxiliary agents as necessary. Examples of such auxiliary agents include zinc stearate, calcium stearate, polyethylene wax, carnauba wax, paraffin wax, ester wax, and like lubricants; sodium dioctyl sulfosuccinate and like surfactants (dispersing agents or wetting agents); antifoaming agents; and potassium alum, aluminium acetate and like water-soluble polyvalent metal salts. In order to further enhance the water resistance, a water-resistance-imparting agent such as glyoxal, boric acid, glyoxylate, dialdehyde starch, a hydrazide compound, and an epoxy compound, may be used together.

When a microcapsule encapsulating an ultraviolet absorber that is liquid at ordinary temperatures, such as 2-(2'-hydroxy-3'-dodecyl-5'-methylphenyl)benzotriazole, is added to the protective layer in an amount such that the proportion of the ultraviolet absorber is preferably about 2to 40 mass %, more preferably about 10to 40 mass %, even more preferably about 15 to 38 mass %, particularly preferably about 15to 35 mass %, and most preferably about 15to 30 mass % based on total solids content of the protective layer, background yellowing and color fading of recorded images due to exposure to light can decrease significantly.

Back Layer

The heat-sensitive recording material according to the first embodiment of the present invention may comprise a back layer mainly comprising a pigment and a binder and formed on the support at the side opposite to the side of the heat-sensitive recording layer as necessary. This can enhance preservability, curling suitability, and printer travel performance. Further, various techniques known in the field of manufacturing heat-sensitive recording materials may be applied as required. For example, the rear surface of the heat-sensitive recording material may be treated with an adhesive to form an adhesive label, or may be provided with a magnetic recording layer, a coating layer for printing, a thermal transfer recording layer, an ink jet recording layer, or the like.

Heat-sensitive Recording Material

The methods for forming the heat-sensitive recording layer and optionally provided undercoat layer, protective layer, and back layer are not particularly limited. For example, after an undercoat layer coating composition is applied to a support by an appropriate coating method, such as bar coating, air knife coating, vali-bar blade coating, pure blade coating, rod blade coating, short dwell coating, curtain coating, or die coating, and dried, a coating composition for heat-sensitive recording layers is applied to the undercoat layer and dried and a protective layer coating composition is applied to the heat-sensitive recording layer and dried.

The undercoat layer according to the first embodiment of the present invention is preferably formed by blade coating. This eliminates irregularities on the surface of the support and allows for the formation of a heat-sensitive recording layer with uniform thickness, thus increasing the recording sensitivity and enhancing the barrier properties of a protective layer provided as necessary. The blade coating is not limited to methods using a blade coater, such as a bevel blade or a bent blade, and includes rod blade coating, bill blade coating, and like coating methods.

The heat-sensitive recording material according to the first embodiment of the present invention preferably comprises at least one layer formed on or above a support by curtain coating. This allows for the formation of a layer having a uniform thickness and thus can enhance recording sensitivity and barrier properties against oils, plasticizers, alcohols, etc. Curtain coating is a method in which a coating composition is dropped onto a support as a free-falling curtain and applied in a non-contact manner. Usable curtain coating methods are not particularly limited, and known methods, such as slide curtain coating, couple curtain coating, and twin curtain coating, may be used. In curtain coating, simultaneous multilayer application can form layers with a more uniform thickness. In simultaneous multilayer coating, after coating compositions are layered, the resulting laminate may be applied and dried to form layers. Alternatively, after a coating composition for forming a lower layer is applied, a coating composition for forming an upper layer may be applied to the lower-layer surface while it is wet, without drying, and then dried to form layers. In the present invention, simultaneous multilayer coating of a heat-sensitive recording layer and a protective layer is preferable from the viewpoint of improving barrier properties.

In the present invention, in view of enhancing the recording sensitivity and improving the image uniformity, the surface is preferably subjected to smoothing treatment by using a known method, such as supercalendering or soft calendaring, after each of the layers is formed or in any step after all of the layers are formed.

In the present invention, a multicolor heat-sensitive recording material may be formed to provide a product of higher value. Generally, forming a multicolor heat-sensitive recording materials is an attempt to utilize a heating temperature difference or a thermal energy difference. A multicolor heat-sensitive recording material is typically configured in such a manner that a high-temperature color-developing layer and a low-temperature color-developing layer, each of which forms a different color, are sequentially overlaid on a support. Such multicolor heat-sensitive recording materials can be roughly classified into two types, i.e., decolorizing materials and color-mixing materials, and are produced by using a method with microcapsules and a method with composite particles comprising an organic polymer and a leuco dye.

2. Heat-sensitive Recording Material According to the Second Embodiment of the Present Invention The heat-sensitive recording material according to the second embodiment of the present invention comprising a support, an undercoat layer comprises a pigment and a binder and formed on the support, and a heat-sensitive recording layer comprising a leuco dye and a developer and formed on the undercoat layer. The layer structure of the heat-sensitive recording material is not limited to a structure consisting of a support, an undercoat layer, and a heat-sensitive recording layer, but also includes a structure comprising a protective layer on the heat-sensitive recording layer, and a structure comprising a back layer on the support at the side opposite to the heat-sensitive layer.

Support

Neutral paper is used as a support in the heat-sensitive recording material according to the second embodiment of the present invention. This can solve the problems of acidic paper deterioration and background fogging, and preserve the heat-sensitive recording material for a long period of time. The type and production method of neutral paper may be the same as those mentioned above in the "Support" section of "1. Heat-sensitive Recording Material According to the First Embodiment of the Present Invention." The neutral paper preferably has a hot-water extraction pH (based on JIS P 8133) of about 6.0 to 11, more preferably 6.5 to 10, even more preferably 7.5 to 10. Background fogging during blank-paper storage can be effectively inhibited by adjusting neutral paper to a pH of 6.0 or higher. Decrease in color-developing ability after blank-paper storage as well as agglomeration of the pulp slurry itself can be effectively inhibited by adjusting neutral paper to a pH of 11 or less. Further, if necessary, aluminum sulfate may be used to adjust the pH within the range of not lower than a pH of 6.0, thus improving paper-making properties. The acidic paper in the present invention has a pH of not lower than 2 and not higher than 6, and preferably a pH of about 2 to 5.7.

The type, production method, etc. of the pulp fiber used in the present invention may be the same as those mentioned above in the "Support" section of "1. Heat-sensitive Recording Material According to the First Embodiment of the Present Invention."

Heat-sensitive Recording Layer

The heat-sensitive recording layer of the heat-sensitive recording material according to the second embodiment of the present invention may comprise any of various colorless or pale-colored known leuco dyes. Specific examples of the leuco dye include those mentioned in the "Heat-sensitive Recording Layer" section of "1. The Heat-sensitive Recording Material according to the First Embodiment of the Present Invention."

The heat-sensitive recording layer in the heat-sensitive recording material according to the second embodiment of the present invention comprises as a developer a specific sulfonamide compound as mentioned above. Based on this feature, the heat-sensitive recording material has high recording density, and has excellent heat resistance in unrecorded portions and excellent plasticizer resistance in recorded portions. Furthermore, even when neutral paper is used as a support, excellent blank-paper preservability can be exhibited.

The amount of the specific sulfonamide compound in the heat-sensitive recording layer of the heat-sensitive recording material according to the second embodiment of the present invention is preferably about 0.5 to 5.0 parts by mass, more preferably about 0.8 to 4 parts by mass, and even more preferably about 1 to 4 parts by mass, and particularly preferably about 1.2 to 3.5 parts by mass, per part by mass of the leuco dye. When the amount of the specific sulfonamide compound is 0.5 parts by mass or more per part by mass of the leuco dye, sufficient recording density can be obtained. When the amount of the specific sulfonamide compound is 5 mass parts or less, background fogging in high-temperature environments can be effectively inhibited.

The developer in the heat-sensitive recording material according to the second embodiment of the present invention comprises a specific sulfonamide compound, and various known materials may also be used with the developer as long as the effects of the present invention are not impaired. Specific examples of such usable materials include those mentioned in the "Heat-sensitive Recording Layer" section of "1. Heat-sensitive Recording Material According to the First Embodiment of the Present Invention." The "specific urea-urethane compound" and "specific diphenylsulfone-crosslinked compound" mentioned in the "Heat-sensitive Recording Layer" section of "1. Heat-sensitive Recording Material According to the First Embodiment of the Present Invention" may also be included.

The coating composition for heat-sensitive recording layers typically comprises any of various resins as a binder. Examples of such binders include those mentioned in the "Heat-sensitive Recording Layer" section of "1. Heat-sensitive Recording Material According to the First Embodiment of the Present Invention."

In the heat-sensitive recording material according to the second embodiment of the present invention, the heat-sensitive recording layer may further comprise a preservability-improving agent, a sensitizer, and other various auxiliary agents, in addition to the specific developer, leuco dye, and binder. Examples of usable preservability-improving agents, sensitizers, and other various auxiliary agents are those mentioned in the "Heat-sensitive Recording Layer" section of "1. Heat-sensitive Recording Material According to the First Embodiment of the Present Invention."

In the heat-sensitive recording material according to the second embodiment of the present invention, the heat-sensitive recording layer can contain fine pigment particles having high whiteness and an average particle diameter of 10 μm or less to improve whiteness of the heat-sensitive recording layer and improving uniformity of images. Specific examples of usable fine pigment particles include those mentioned in the "Heat-sensitive Recording Layer" section of "1. Heat-sensitive Recording Material According to the First Embodiment of the Present Invention."

The heat-sensitive recording layer of the heat-sensitive recording material according to the second embodiment of the present invention is formed by application to a support and drying in the same manner as the method described in the "Heat-sensitive Recording Layer" section of "1. Heat-sensitive Recording Material According to the First Embodiment of the Present Invention."

Undercoat Layer

The heat-sensitive recording material according to the second embodiment of the present invention preferably comprises an undercoat layer comprising hollow plastic particles and formed between the support and the heat-sensitive recording layer. This can further enhance recording sensitivity. The hollow plastic particles remaining on the support allow for the formation of a uniform undercoat layer and thereby enhance barrier properties. This can prevent the developer from forming a salt with an alkaline filler contained in the neutral paper, thus inhibiting decrease in color-developing ability. Examples of usable hollow plastic particles are those mentioned in the "Undercoat Layer" section of "1. Heat-sensitive Recording Material According to the First Embodiment of the Present Invention."

In the heat-sensitive recording material according to the second embodiment of the present invention, application of the undercoat layer by blade coating can enhance the surface smoothness of the undercoat layer in terms of quality, and enables curtain coating, thus enhancing the barrier properties of a protective layer optionally provided. The amount of the hollow plastic particles may be the same as those mentioned in the "Undercoat Layer" of "1. Heat-sensitive Recording Material According to the First Embodiment of the Present Invention."

In the second embodiment of the present invention, the undercoat layer of the heat-sensitive recording material preferably comprises an oil-absorbing pigment with an oil absorption of 70 ml/100 g or more, and particularly about 80 to 150 ml/100 g to enhance inhibitory effects on adhesion of the residue to a thermal head. The undercoat layer may also comprise thermal expansion particles. The oil absorption referred to herein is determined in accordance with JIS K 5101.

The oil-absorbing pigment may be any of various oil-absorbing pigments. Specific examples of usable oil-absorbing pigments include those mentioned in the "Undercoat Layer" section of "1. Heat-sensitive Recording Material According to the First Embodiment of the Present Invention."

In the heat-sensitive recording material according to the second embodiment of the present invention, the undercoat layer is generally formed by preparing an undercoat layer coating composition by mixing hollow plastic particles, an oil-absorbing pigment, a binder, auxiliary agents, etc., using water as a medium, applying the coating composition to a support and drying. The amount of the undercoat layer coating composition applied is not particularly limited, but is preferably about 3 to 20 g/m$^2$, and preferably about 5 to 12 g/m$^2$.

Examples of usable binders are those mentioned in the above "Undercoat Layer" section of "1. The Heat-sensitive Recording Material According to the First Embodiment of the Present Invention."

Protective Layer

The heat-sensitive recording material according to the second embodiment of the present invention may comprise a protective layer on a heat-sensitive recording layer in order to improve the recorded-image preservability against chemicals such as plasticizers and oils, or to improve the recording suitability.

The protective layer may be formed, for example, by mixing and stirring a binder, a water-resistance-imparting agent, a pigment, an auxiliary agent, etc., using water as a dispersion medium to prepare a protective layer coating composition, applying the coating composition to the heat-sensitive recording layer to a dry coat weight of preferably about 0.5 to 15 g/m$^2$, and more preferably to about 1.0 to 8 g/m$^2$, and drying.

Specific examples of the binder, pigment, and various auxiliary agents are those mentioned in the "Protective Layer" section of "1. Heat-sensitive Recording Material According to the First Embodiment of the Present Invention."

When microcapsules encapsulating an ultraviolet absorber that is liquid at ordinary temperatures, such as 2-(2'-hydroxy-3'-dodecyl-5'-methylphenyl)benzotriazole, are added into the protective layer in an amount such that the proportion of the ultraviolet absorber is preferably about 2to 40 mass %, more preferably about 2to 35 mass %, and even more preferably about 3 to 30 mass %, based on total solids content of the protective layer, background yellowing and color fading of recorded images due to exposure to light can be significantly inhibited.

The heat-sensitive recording material according to the second embodiment of the present invention may comprise a back layer mainly comprising a pigment and a binder and formed on the support at the side opposite to the side of the heat-sensitive recording layer. This can further enhance preservability, curling suitability, and printer travel performance. Further, various techniques known in the field of manufacturing heat-sensitive recording materials may be applied as required. For example, the rear surface of the heat-sensitive recording material may be treated with an adhesive to form an adhesive label, or may be provided with a magnetic recording layer, a coating layer for printing, a thermal transfer recording layer, an ink jet recording layer, or the like.

Heat-sensitive Recording Material

The methods for forming the undercoat layer, the heat-sensitive recording layer, and the optionally provided protective layer and back layer are not particularly limited. The methods mentioned above in the "Heat-sensitive Recording Material" section of "1. Heat-sensitive Recording Material According to the First Embodiment of the Present Invention" can be used to form the layers.

EXAMPLES

The present invention is described in further detail with reference to Examples. However, the scope of the present invention is not limited to these Examples. "Part" and "%" mean "part by mass" and "mass %," respectively, unless otherwise specified.

Example 1-1

Preparation of Undercoat Layer Coating Composition (1a)

A composition consisting of 80 parts of a hollow plastic particle dispersion (trade name: Ropaque SN-1055, hollow ratio: 55%, average particle diameter: 1.0 μm, produced by Dow Chemical Co., solids content: 26.5 mass %), 140 parts of a 50% aqueous dispersion of calcined kaolin (trade name: Ansilex, produced by BASF) (average particle diameter: 0.6 μm), 20 parts of styrene-butadiene latex (trade name: L-1571, produced by Asahi Kasei Chemicals Co., solids content: 48 wt %), 50 parts of a 10% aqueous solution of oxidized starch, and 20 parts of water was mixed to obtain an undercoat layer coating composition (1a).

Preparation of Liquid A1(Leuco Dye Dispersion)

A composition consisting of 100 parts of 3-di(n-butyl) amino-6-methyl-7-anilinofluoran, 50 parts of a 20% aqueous solution of polyvinyl alcohol (saponification degree: 60 mol %, degree of polymerization: 200), 20 parts of a 5% emulsion of a glycerol ester emulsion antifoaming agent (trade name: Nopco 1407H, produced by San Nopco Co.), and 80 parts of water was pulverized with a sand mill to a median size of 0.5 μm as measured with a laser diffraction particle size distribution analyzer (SALD2200 produced by Shimadzu Corporation) to obtain liquid A1

Preparation of Liquid B1(Developer Dispersion)

A composition consisting of 100 parts of N-[2-(3-phenylureido)phenyl]benzenesulfonamide, 50 parts of a 20% aqueous solution of sulfone-modified polyvinyl alcohol (trade name: Goselane L-3266, produced by The Nippon Synthetic Chemical Industry Co., Ltd.), 10 parts of a 5% emulsion of a glycerol ester emulsion antifoaming agent (trade name: Nopco 1407H, produced by San Nopco Co.), and 90 parts of water was pulverized with a sand mill to a median size of 1.0 μm as measured with a laser diffraction particle size distribution analyzer (SALD2200 produced by Shimadzu Corporation) to obtain Liquid B1

Preparation of Liquid C1(Developer Dispersion)

A composition consisting of 100 parts of 4,4'-bis[(4-methyl-3-phenoxycarbonylaminophenyl)ureido]diphenylsulfone, 50 parts of a 20% aqueous solution of sulfone-modified polyvinyl alcohol (trade name: Goselane L-3266, produced by The Nippon Synthetic Chemical Industry Co., Ltd.), 10 parts of a 5% emulsion of a glycerol ester emulsion antifoaming agent (trade name: Nopco 1407H, produced by San Nopco Co.), and 90 parts of water was pulverized with a sand mill to a median size of 1.0 μm as measured with a laser diffraction particle size distribution analyzer (SALD2200 produced by Shimadzu Corporation) to obtain Liquid C1

Preparation of Liquid D1(Sensitizer Dispersion)

A composition consisting of 100 parts of 1,2-di(3-methylphenoxy)ethane, 50 parts of a 20% aqueous solution of sulfone-modified polyvinyl alcohol (trade name: Goselane L-3266, produced by The Nippon Synthetic Chemical Industry Co., Ltd.), 2 parts of a 5% emulsion of a glycerol ester emulsion antifoaming agent (trade name: Nopco 1407H, produced by San Nopco Co.), and 98 parts of water was pulverized with a sand mill to a median size of 1.0 μm as measured with a laser diffraction particle size distribution analyzer (SALD2200 produced by Shimadzu Corporation) to obtain Liquid D1

Preparation of Coating Composition for Heat-Sensitive Recording Layers (1b)

A composition consisting of 25 parts of Liquid A1 65 parts of Liquid B1 25 parts of Liquid C1 35 parts of Liquid D1 20 parts of aluminum hydroxide (trade name: HIGILITE H-42, produced by Showa Denko K.K.), 125 parts of an 12% aqueous solution of polyvinyl alcohol with a saponification degree of 98% and a polymerization degree of 1,000, 5 parts of a 35% aqueous dispersion of adipic dihydrazide, 0.5 parts of a 10% aqueous solution of sodium dioctylsulfosuccinate, and 20 parts of water was mixed to obtain a coating composition for heat-sensitive recording layers (1b).

Preparation of Liquid E1 (Kaolin Dispersion)

A composition consisting of 50 parts of kaolin (trade name: UW-90®, produced by BASF), 4 parts of particulate amorphous silica (trade name: Mizucasile P-527, produced by Mizusawa Industrial Chemicals, Ltd.), 0.4 part of a 40% aqueous solution of sodium polyacrylate (trade name: Aron T-50, produced by Toagosei Co., Ltd.), and 81 parts of water to obtain Liquid E1.

Preparation of Protective Layer Coating Composition (1c)

A composition consisting of 135 parts of Liquid E1, 250 parts of a 10% aqueous solution of acetoacetyl-modified polyvinyl alcohol (trade name: Gohsefimer Z-200, produced by Nippon Synthetic Chemical Industry Co., Ltd., degree of polymerization: 1000), 20 parts of an aqueous dispersion of zinc stearate (trade name: Hidorin Z-8-36, solids content: 36%, produced by Chukyo Yushi Co., Ltd.), 45 parts of an ionomeric urethane resin latex (trade name: Hydran® AP-30F, produced by DIC Corporation, solids content: 20%), and 0.5 parts of an 10% aqueous solution of sodium dioctylsulfosuccinate was mixed to obtain a protective layer coating liquid (1c).

Production of Heat-Sensitive Recording Material

The undercoat layer coating composition (1a) was applied to one side of high-quality paper (acidic paper) having a basis weight of 64 g/m$^2$ to a dry coat weight of 7 g/m$^2$ by blade coating using a blade coater, and dried to form an undercoat layer. The coating composition for heat-sensitive recording layers (1b) was applied to the undercoat layer to a dry coat weight of 3.5 g/m$^2$ by curtain coating using a slide-hopper curtain coater, and dried to form a heat-sensitive recording layer. The protective layer coating composition (1c) was applied to the heat-sensitive recording layer to a dry coat weight of 2.5 g/m$^2$, and dried to form a protective layer, followed by supercalendering to obtain a heat-sensitive recording material.

Example 1-2

A heat-sensitive recording material was obtained in the same manner as in Example 1-1 except that in the preparation of the coating composition for heat-sensitive recording layers (1b) of Example 1-1, Liquid B1 was used in an amount of 85 parts in place of 65 parts, and Liquid C1 was used in an amount of 5 parts in place of 25 parts.

Example 1-3

A heat-sensitive recording material was obtained in the same manner as in Example 1-1 except that in the preparation of the coating composition for heat-sensitive recording layers (1b) of Example 1-1, Liquid B1 was used in an amount of 30 parts in place of 65 parts, and Liquid C1 was used in an amount of 60 parts in place of 25 parts.

Preparation of Liquid F1 (Developer Dispersion)

A composition consisting of 100 parts of 4,4'-bis[(4-methyl-3-phenoxycarbonylaminophenyl)ureido]diphenylsulfone, 5 parts of magnesium silicate, 50 parts of a 20% aqueous solution of sulfone-modified polyvinyl alcohol (trade name: Goselane L-3266, produced by The Nippon Synthetic Chemical Industry Co., Ltd.), 10 parts of a 5% emulsion of a glycerol ester emulsion antifoaming agent (trade name: Nopco 1407H, produced by San Nopco Co.), and 90 parts of water was pulverized with a sand mill to a median size of 1.0 μm as measured with a laser diffraction particle size distribution analyzer (SALD2200 produced by Shimadzu Corporation) to obtain a dispersion. The dispersion was heat-treated at 70° C. for 4 hours to obtain Liquid F1.

Example 1-4

A heat-sensitive recording material was obtained in the same manner as in Example 1-1 except that in the preparation of the coating composition for heat-sensitive recording layers (1b) of Example 1-1, Liquid F1 was used in place of Liquid C1

Example 1-5

Production of Undercoat Layer-Coated Base Paper

The undercoat layer coating composition (1a) was applied to one side of high-quality paper (acidic paper) having a basis weight of 64 g/m$^2$ to a dry coat weight of 7 g/m$^2$ by blade coating using a blade coater and dried to form an undercoat layer. A base paper having an undercoat layer formed thereon was thus obtained.

Production of Heat-Sensitive Recording Material

The coating composition for heat-sensitive recording layers (1b) and the protective layer coating composition (1c) were simultaneously applied by simultaneous multilayer curtain coating to the undercoat layer-coated base paper prepared above in amounts of 3.5 g/m$^2$ and 2.5 g/m$^2$, respectively, on a solids basis, at an application rate of 600 m/min, using a slide-hopper curtain coater, to form a multilayer coating film in which the coating composition for heat-sensitive recording layers (1b) and the protective layer coating composition (1c) were layered in this order from the lower-layer side, i.e., the side closer to the base paper, and dried to form a heat-sensitive recording layer and a protective layer. The resulting product was then supercalendered to obtain a heat-sensitive recording material.

Comparative Example 1-1

A heat-sensitive recording material was obtained in the same manner as in Example 1-1 except that in the preparation of the coating composition for heat-sensitive recording layers (1b) of Example 1-1, Liquid B1 was not used and Liquid C1 was used in an amount of 90 parts in place of 25 parts.

Comparative Example 1-2

A heat-sensitive recording material was obtained in the same manner as in Example 1-1 except that in the preparation of the coating composition for heat-sensitive recording layers (1b) of Example 1-1, Liquid B1 was used in an amount of 90 parts in place of 65 parts and Liquid C1 was not used.

Comparative Example 1-3

A heat-sensitive recording material was obtained in the same manner as in Example 1-1 except that in the preparation of Liquid B1of Example 1-1, 4-hydroxy-4'-isopropoxydiphenylsulfone (trade name: D-8, product of Nippon Soda Co., Ltd.) was used in place of N-[2-(3-phenylureido)phenyl]benzenesulfonamide.

The heat-sensitive recording materials thus obtained were evaluated for the following properties. Table 1 shows the results.

Recording Density 1

An image was recorded on each of the heat-sensitive recording materials at an applied energy of 0.27 mJ/dot using a thermal recording tester (TH-PMD, produced by Ohkura Electric Co., Ltd.), and the density of the recorded area and unrecorded area (background portion) was measured with a Macbeth transmission reflection densitomter (trade name: RD-914, produced by Macbeth Co., Ltd.) in visual mode. The greater the numerical value, the higher the recording density. The recorded area preferably has a recording density of 1.20 or more for practical use. In the background portion, the smaller numerical value, the more preferable. When the density of the background portion is more than 0.2, background fogging becomes problematic.

Heat Resistance 1

Each of the heat-sensitive recording materials before recording was allowed to stand in a high-temperature environment of 80° C. for 24 hours, and the optical density of the unrecorded area (background portion) was measured with a reflection densitomter (trade name: Macbeth transmission reflection densitometer RD-914, produced by Macbeth Co., Ltd.) in visual mode. The smaller the numerical value, the more preferable. When the density of the background portion is more than 0.2, resistance to background fogging becomes problematic.

Alcohol Resistance

Each of the heat-sensitive recording materials that had been subjected to color development for measuring recording density was immersed in 30% ethanol for 24 hours for treatment and then dried. The density of the recorded area was then measured in visual mode with a Macbeth Transmission Reflection Densitometer (trade name: Model RD-914, produced by Macbeth Co., Ltd.). Further, the preservation percentage of the recorded area was calculated according to the following equation. When the heat-sensitive recording material after the treatment has a recording density of 1.0 or more and a preservation percentage of 60% or more, the heat-sensitive recording material is satisfactory.

Preservation (%)=(Recording density after the treatment/Recording density before the treatment)×100

Plasticizer Resistance 1

A wrap film (trade name: Hi-wrap KMA-W, produced by Mitsui Chemicals, Inc.) was wound around a polycarbonate pipe (diameter: 40 mm) three times, and each of the heat-sensitive recording materials that had been subjected to color development for measuring the recording density was placed on the film. The wrap film was further wound around the heat-sensitive recording material three times, and the heat-sensitive recording materials were allowed to stand at 40° C. and 80% RH for 24 hours for treatment. The density of a recorded portion was then measured with a reflection densitometer (trade name: Macbeth transmission reflection densitometer RD-914, produced by Macbeth Co., Ltd.) in visual mode. The preservation percentage of the recorded portion was also calculated according to the following equation. When the heat-sensitive recording material after the treatment has a recording density of 1.0 or more and a preservation percentage of 60% or more, the heat-sensitive recording material is satisfactory.

Preservation (%)=(Recording density after the treatment/Recording density before the treatment)×100

TABLE 1

| | Recording density 1 | | Heat resistance 1 | Alcohol resistance | | Plasticizer resistance 1 | |
|---|---|---|---|---|---|---|---|
| | Recorded part | Background portion | Background portion density | Recording density | Preservation (%) | Recording density | Preservation (%) |
| Example 1-1 | 1.35 | 0.08 | 0.12 | 1.20 | 89% | 1.25 | 93% |
| Example 1-2 | 1.38 | 0.07 | 0.11 | 1.05 | 76% | 1.11 | 80% |
| Example 1-3 | 1.30 | 0.09 | 0.14 | 1.22 | 94% | 1.22 | 94% |
| Example 1-4 | 1.35 | 0.06 | 0.08 | 1.15 | 85% | 1.20 | 89% |
| Example 1-5 | 1.36 | 0.08 | 0.12 | 1.20 | 88% | 1.25 | 92% |
| Comp. Ex. 1-1 | 1.05 | 0.08 | 0.10 | 0.90 | 86% | 0.70 | 67% |
| Comp. Ex. 1-2 | 1.38 | 0.07 | 0.09 | 0.45 | 33% | 0.76 | 55% |
| Comp. Ex. 1-3 | 1.40 | 0.10 | 0.60 | 0.60 | 43% | 0.60 | 43% |

Example 1-6

Preparation of Undercoat Layer Coating Composition (2a)

A composition consisting of 120 parts of a hollow plastic particle dispersion (trade name: Ropaque SN-1055, hollow ratio: 55%, average particle diameter: 1.0 μm, produced by Dow Chemical Co., solids content: 26.5 mass %), 110 parts of a 50% aqueous dispersion of calcined kaolin (trade name: Ansilex, produced by BASF) (average particle diameter: 0.6 μm), 20 parts of styrene-butadiene latex (trade name: L-1571, produced by Asahi Kasei Chemicals Co., solids content: 48 wt %), 50 parts of a 10% aqueous solution of oxidized starch, and 20 parts of water was mixed to obtain an undercoat layer coating composition (2a).

Preparation of Liquid A2 (Leuco Dye Dispersion)

A composition consisting of 100 parts of 3-di(n-butyl) amino-6-methyl-7-anilinofluoran, 50 parts of a 20% aqueous solution of sulfone-modified polyvinyl alcohol (trade name: Goselane L-3266, produced by The Nippon Synthetic Chemical Industry Co., Ltd.), 10 parts of a 5% emulsion of a glycerol ester emulsion antifoaming agent (trade name: Nopco 1407H, produced by San Nopco Co.), and 80 parts of water was pulverized with a sand mill to a median size of 0.5 μm as measured with a laser diffraction particle size distribution analyzer (SALD2200 produced by Shimadzu Corporation) to obtain Liquid A2.

Preparation of Liquid B2 (Developer Dispersion)

A composition consisting of 100 parts of N-[2-(3-phenylureido)phenyl]benzenesulfonamide, 50 parts of a 20% aqueous solution of sulfone-modified polyvinyl alcohol (trade name: Goselane L-3266, produced by The Nippon Synthetic Chemical Industry Co., Ltd.), 10 parts of a 5% emulsion of a glycerol ester emulsion antifoaming agent (trade name: Nopco 1407H, produced by San Nopco Co.), and 90 parts of water was pulverized with a sand mill to a median size of 1.0 μm as measured with a laser diffraction particle size distribution analyzer (SALD2200 produced by Shimadzu Corporation) to obtain Liquid B2.

Preparation of Liquid C2 (Developer Dispersion)

A composition consisting of 100 parts of a diphenylsulfone-crosslinked compound represented by formula (3) (trade name: D-90, produced by Nippon Soda Co., Ltd.), 50 parts of a 20% aqueous solution of sulfone-modified polyvinyl alcohol (trade name: Goselane L-3266, produced by The Nippon Synthetic Chemical Industry Co., Ltd.), 10 parts of a 5% emulsion of a glycerol ester emulsion antifoaming agent (trade name: Nopco 1407H, produced by San Nopco Co.), and 90 parts of water was pulverized with a sand mill to a median size of 1.0 μm as measured with a laser diffraction particle size distribution analyzer (SALD2200 produced by Shimadzu Corporation) to obtain Liquid C2.

Preparation of Liquid D2 (Sensitizer Dispersion)

A composition consisting of 100 parts of 1,2-di(3-methylphenoxy)ethane, 50 parts of a 20% aqueous solution of sulfone-modified polyvinyl alcohol (trade name: Goselane L-3266, produced by The Nippon Synthetic Chemical Industry Co., Ltd.), 2 parts of a 5% emulsion of a glycerol ester emulsion antifoaming agent (trade name: Nopco 1407H, produced by San Nopco Co.), and 98 parts of water was pulverized with a sand mill to a median size of 1.0 μm as measured with a laser diffraction particle size distribution analyzer (SALD2200 produced by Shimadzu Corporation) to obtain liquid D2.

Preparation of Coating Composition for Heat-Sensitive Recording Layers (2b)

A composition consisting of 23 parts of Liquid A2, 30 parts of Liquid B2, 33 parts of Liquid C2, 30 parts of Liquid D2, 20 parts of aluminum hydroxide (trade name: HIGILITE H-42, average particle diameter: 1.0 μm, produced by Showa Denko K.K.), 10 parts of fine powder amorphous silica (trade name: Mizucasile P-605, average particle diameter: 3.0 μm, produced by Mizusawa Industrial Chemicals, Ltd.), 120 parts of a 10% aqueous solution of starch-vinylacetate graft copolymer (trade name: Petrocoat C-8, produced by Nippon Starch Chemical Co., Ltd.), 20 parts of a 10% aqueous solution of a fully saponified polyvinyl alcohol (trade name: Gohsenol NM-11, produced by The Nippon Synthetic Chemical Industry Co., Ltd.), 15 parts of a dispersion of zinc stearate (trade name: Hidorin Z-8-36, solids content: 36%, produced by Chukyo Yushi Co., Ltd.), and 20 parts of water was mixed and stirred to obtain a coating composition for heat-sensitive recording layers (2b).

Production of Heat-Sensitive Recording Material

The undercoat layer coating composition (2a) was applied to one side of high-quality paper (acidic paper with a hot-water extraction pH of 5.3) having a basis weight of 53 g/m$^2$ as a support to a dry coat weight of 5.5 g/m$^2$ by blade coating using a blade coater, and dried to form an undercoat layer. The coating composition for heat-sensitive recording layers (2b) was applied to the undercoat layer to a dry coat weight of 3.5 g/m$^2$ by curtain coating using a slide hopper curtain coater and dried, and then supercalendered to form a heat-sensitive recording layer.

Example 1-7

A heat-sensitive recording material was obtained in the same manner as in Example 1-6 except that in the preparation of the coating composition for heat-sensitive recording layers (2b) of Example 1-6, Liquid B2 was used in an amount of 50 parts in place of 30 parts, and that Liquid C2 was used in an amount of 11 parts in place of 33 parts.

Example 1-8

A heat-sensitive recording material was obtained in the same manner as in Example 1-6 except that in the preparation of the coating composition for heat-sensitive recording layers (2b) of Example 1-6, Liquid B2 was used in an amount of 21 parts in place of 30 parts, and Liquid C2 was used in an amount of 40 parts in place of 33 parts.

Example 1-9 to Example 1-11

Heat-sensitive recording materials were produced in the same manner as Examples 1-6 to 1-8 except that in the preparation of the heat-sensitive recording materials of Examples 1-6 to 1-8, high-quality paper (neutral paper with a hot-water extraction pH of 8.8) was used as a support in place of high-quality paper having a basis weight of 53 g/m$^2$ (acidic paper with a hot-water extraction pH of 5.3).

Comparative Example 1-4

A heat-sensitive recording material was obtained in the same manner as in Example 1-6 except that in the preparation of Liquid B2 of Example 1-6, 4-hydroxy-4'-isopropoxydiphenylsulfone (trade name: D-8, produced by Nippon Soda Co., Ltd.) was used in place of N-[2-(3-phenylureido)phenyl]benzenesulfonamide.

Comparative Example 1-5

A heat-sensitive recording material was obtained in the same manner as in Example 1-6 except that in the preparation of Liquid B2 of Example 1-6, N-p-toluenesulfonyl-N'-3-(p-toluenesulfonyloxy)phenylurea (trade name: PF-201, produced by BASF) was used in place of N-[2-(3-phenylureido)phenyl]benzenesulfonamide.

Comparative Example 1-6

A heat-sensitive recording material was obtained in the same manner as in Example 1-6 except that in the preparation of Liquid B2 of Example 1-6,4,4'-dihydroxydiphenylsulfone was used in place of N-[2-(3-phenylureido)phenyl]benzenesulfonamide.

Comparative Example 1-7

A heat-sensitive recording material was obtained in the same manner as in Example 1-6 except that in the preparation of the coating composition for heat-sensitive recording layers (2b) of Example 1-6, Liquid B2 was not used and that Liquid C2 was used in an amount of 63 parts in place of 33 parts, and that in the production of the heat-sensitive recording material, high-quality paper (neutral paper with a hot-water extraction pH of 8.8) was used as a support in place of high-quality paper having a basis weight of 53 g/m$^2$ (acidic paper with a hot-water extraction pH of 5.3).

Comparative Example 1-8

A heat-sensitive recording material was obtained in the same manner as in Example 1-6 except that in the preparation of the coating composition for heat-sensitive recording layers (2b) of Example 1-6, Liquid B2 was used in an amount of 63 parts in place of 30 parts and that Liquid C2 was not used, and that in the production of the heat-sensitive recording material, high-quality paper (neutral paper with a hot-water extraction pH of 8.8) was used as a support in place of high-quality paper having a basis weight of 53 g/m$^2$ (acidic paper with a hot-water extraction pH of 5.3).

Comparative Examples 1-9 to 1-11

Heat-sensitive recording materials were obtained in the same manner as in Comparative Example 1-4 to 1-6 except that in the production of heat-sensitive recording materials of Comparative Example 1-4 to 1-6, high-quality paper (neutral paper with a hot-water extraction pH of 8.8) was used as a support in place of high-quality paper having a basis weight of 53 g/m$^2$ (acidic paper with a hot-water extraction pH of 5.3).

The heat-sensitive recording materials thus obtained were evaluated for the following properties. Table 2 shows the results.

Recording Density 2

An image was recorded on each of the heat-sensitive recording materials at an applied energy of 0.28 mJ/dot using a thermal recording tester (trade name: TH-PMD, produced by Ohkura Electric Co., Ltd.). The optical density of the recorded area and unrecorded area (background portion) was measured with a reflection densitometer (trade name: Macbeth transmission reflection densitometer RD-918, produced by GretagMacbeth Co., Ltd.) in visual mode. The greater the numerical value, the higher the recording density. The recorded area preferably has a recording density of 1.20 or more for practical use. In the background portion, the smaller the numerical value, the more preferable. When the density of the background portion is more than 0.2, background fogging becomes problematic.

Heat Resistance 2

After each of the heat-sensitive recording materials before recording was allowed to stand in a high-temperature environment of 80° C. for 2 hours, the optical density of the unrecorded area (background portion) was measured with a reflection densitometer (trade name: Macbeth transmission reflection densitometer RD-918, produced by GretagMacbeth Co., Ltd.) in visual mode. The smaller the numerical value, the more preferable. When the density of the background portion is more than 0.2, thermal background fogging resistance becomes problematic.

Plasticizer Resistance 2

A wrap film (trade name: Hi-S Soft, produced by Nippon Carbide Industries Co., Ltd.) was wound around a polycarbonate pipe (diameter: 40 mm) three times, and each of the heat-sensitive recording materials that had been subjected to color development for measuring the recording density was placed on the film. The wrap film was further wound around the heat-sensitive recording material three times and allowed to stand at 23° C. and 50% RH for 24 hours for treatment. The density of the recorded area was then measured with a reflection densitometer (trade name: Macbeth transmission reflection densitometer RD-918, produced by GretagMacbeth Co., Ltd.) in visual mode. Further, the preservation percentage of the recorded area was calculated according to the following equation. When the heat-sensitive recording material after the treatment has a recording density of 1.0 or more and a preservation percentage of 60% or more, the heat-sensitive recording material is satisfactory.

Preservation (%)=(Recording density after the treatment/Recording density before the treatment)×100

In (1) of Comparative Example 1-8 in Table 2, measurement values obtained above in the "Plasticizer Resistance 2" section are shown. In (2) of Comparative Example 1-8 in Table 2, measurement values obtained under the same measurement conditions as for "Plasticizer Resistance 2" above except that the heat-sensitive recording materials were allowed to stand for 12 hours are shown.

Plasticizer Resistance after Blank-Paper Storage

After each of the heat-sensitive recording materials before recording was stored in a blank (unrecorded) state in an environment of 40° C. and 90% RH for 7 days as an accelerated test, an image was recorded on the heat-sensitive recording materials at an applied energy of 0.28 mJ/dot using a thermal recording tester (trade name: TH-PMH, produced by Ohkura Electric Co., Ltd.). The plasticizer resistance was evaluated in the same manner as for Plasticizer Resistance 2 above.

In (1) of Comparative Example 1-8 in Table 2, measurement values obtained above in "Plasticizer Resistance after Blank-paper Storage" section are shown. In (2) of Comparative Example 1-8 in Table 2, measurement values obtained under the same measurement conditions as for "Plasticizer Resistance after Blank-paper Storage" above except that the heat-sensitive recording materials were allowed to stand for 12 hours are shown.

TABLE 2

| | Recording density 2 | | Heat resistance 2 | Plasticizer resistance 2 | | Plasticizer resistance after blank-paper preservation | |
|---|---|---|---|---|---|---|---|
| | Recorded portion | Background portion | Background portion density | Recording density | Preservation (%) | Recording density | Preservation (%) |
| Example 1-6 | 1.32 | 0.06 | 0.11 | 1.28 | 97% | 1.28 | 97% |
| Example 1-7 | 1.36 | 0.07 | 0.10 | 1.15 | 85% | 1.15 | 85% |
| Example 1-8 | 1.25 | 0.06 | 0.12 | 1.18 | 94% | 1.18 | 94% |
| Example 1-9 | 1.31 | 0.05 | 0.09 | 1.27 | 97% | 1.27 | 97% |
| Example 1-10 | 1.35 | 0.06 | 0.08 | 1.15 | 85% | 1.14 | 84% |
| Example 1-11 | 1.24 | 0.05 | 0.10 | 1.17 | 94% | 1.17 | 94% |
| Comp. Ex. 1-4 | 1.35 | 0.07 | 0.65 | 0.75 | 56% | 0.74 | 55% |
| Comp. Ex. 1-5 | 1.30 | 0.08 | 0.45 | 1.26 | 97% | 1.26 | 96% |
| Comp. Ex. 1-6 | 1.30 | 0.07 | 0.30 | 1.10 | 85% | 1.10 | 83% |
| Comp. Ex. 1-7 | 1.04 | 0.06 | 0.13 | 0.84 | 81% | 0.83 | 80% |
| Comp. Ex. 1-8 | 1.45 | 0.06 | 0.08 | (1) 0.75<br>(2) 1.25 | (1) 52%<br>(2) 86% | (1) 0.74<br>(2) 1.24 | (1) 51%<br>(2) 86% |
| Comp. Ex. 1-9 | 1.35 | 0.06 | 0.35 | 0.73 | 54% | 0.70 | 52% |
| Comp. Ex. 1-10 | 1.28 | 0.06 | 0.40 | 1.20 | 94% | 0.85 | 66% |
| Comp. Ex. 1-11 | 1.27 | 0.06 | 0.28 | 1.05 | 83% | 0.90 | 71% |

Example 1-12

Preparation of Undercoat Layer Coating Composition (3a)

A composition consisting of 120 parts of a hollow plastic particle dispersion (trade name: Ropaque SN-1055, hollow ratio: 55%, average particle diameter: 1.0 μm, produced by The Dow Chemical Co., solids content: 26.5 mass %), 110 parts of a 50% aqueous dispersion of calcined kaolin (trade name: Ansilex, produced by BASF) (average particle diameter: 0.6 μm), 20 parts of styrene-butadiene latex (trade name: L-1571, produced by Asahi Kasei Chemicals Co., solids content: 48 wt %), 50 parts of a 10% aqueous solution of oxidized starch, and 20 parts of water was mixed to obtain an undercoat layer coating composition (3a).

Preparation of Liquid A3 (Leuco Dye Dispersion)

A composition consisting of 100 parts of 3-di(n-butyl) amino-6-methyl-7-anilinofluoran, 50 parts of a 20% aqueous solution of sulfone-modified polyvinyl alcohol (trade name: Goselane L-3266, produced by The Nippon Synthetic Chemical Industry Co., Ltd.), 10 parts of a 5% emulsion of a glycerol ester emulsion antifoaming agent (trade name: Nopco 1407H, produced by San Nopco Co.), and 90 parts of water was pulverized with a sand mill to a median size of 1.0 μm as measured with a laser diffraction particle size distribution analyzer (SALD2200 produced by Shimadzu Corporation) to obtain Liquid A3.

Preparation of Liquid B3 (Developer Dispersion)

A composition consisting of 100 parts of N-[2-(3-phenylureido)phenyl]benzenesulfonamide, 50 parts of a 20% aqueous solution of sulfone-modified polyvinyl alcohol (trade name: Goselane L-3266, produced by The Nippon Synthetic Chemical Industry Co., Ltd.), 10 parts of a 5% emulsion of a glycerol ester emulsion antifoaming agent (trade name: Nopco 1407H, produced by San Nopco Co.), and 90 parts of water was pulverized with a sand mill to a median size of 0.5 μm as measured with a laser diffraction particle size distribution analyzer (SALD2200 produced by Shimadzu Corporation) to obtain liquid B3.

Preparation of Liquid C3 (Developer Dispersion)

A composition consisting of 100 parts of a compound represented by formula (3) (trade name: D-90, produced by Nippon Soda Co., Ltd.), 50 parts of a 20% aqueous solution of sulfone-modified polyvinyl alcohol (trade name: Goselane L-3266, produced by The Nippon Synthetic Chemical Industry Co., Ltd.), 10 parts of a 5% emulsion of a glycerol ester emulsion antifoaming agent (trade name: Nopco 1407H, produced by San Nopco Co.), and 90 parts of water was pulverized with a sand mill to a median size of 1.0 μm as measured with a laser diffraction particle size distribution analyzer (SALD2200 produced by Shimadzu Corporation) to obtain Liquid C3.

Preparation of D3 Solution (Developer Dispersion)

A composition consisting of 100 parts of a urea-urethane compound represented by formula (2) (trade name: UU, produced by Chemipro Kasei Kaisha, Ltd.), 50 parts of a 20% aqueous solution of sulfone-modified polyvinyl alcohol (trade name: Goselane L-3266, produced by The Nippon Synthetic Chemical Industry Co., Ltd.), 2 parts of a 5% emulsion of a glycerol ester emulsion antifoaming agent (trade name: Nopco 1407H, produced by San Nopco Co.), and 98 parts of water was pulverized with a sand mill to a median size of 1.0 μm as measured with a laser diffraction particle size distribution analyzer (SALD2200 produced by Shimadzu Corporation) to obtain Liquid D3.

Preparation of Liquid E3 (Sensitizer Dispersion)

A composition consisting of 100 parts of 1,2-di(3-methylphenoxy)ethane, 50 parts of a 20% aqueous solution of sulfone-modified polyvinyl alcohol (trade name: Goselane L-3266, produced by The Nippon Synthetic Chemical Industry Co., Ltd.), 2 parts of a 5% emulsion of a glycerol ester emulsion antifoaming agent (trade name: Nopco 1407H, produced by San Nopco Co.), and 98 parts of water was pulverized with a sand mill to a median size of 1.0 μm as measured with a laser diffraction particle size distribution analyzer (SALD2200 produced by Shimadzu Corporation) to obtain Liquid E3.

Preparation of Coating Composition for Heat-Sensitive Recording Layers (3b)

A composition consisting of 20 parts of Liquid A3, 28 parts of Liquid B3, 18 parts of Liquid C3, 18 parts of Liquid D3, 25 parts of Liquid E3, 15 parts of aluminum hydroxide (trade name: HIGILITE H-42, average particle diameter: 1.0 produced by Showa Denko K.K.), 18 parts of fine powder amorphous silica (trade name: Mizucasile P-605, average particle diameter: 3.0 produced by Mizusawa Industrial Chemicals, Ltd.), 120 parts of a 10% aqueous solution of a starch-vinyl acetate graft copolymer (trade name: Petrocoat C-8, produced by Nippon Starch Chemical Co., Ltd.), 20 parts of a 10% aqueous solution of a fully saponified polyvinyl alcohol (trade name: Gohsenol NM-11, produced by The Nippon Synthetic Chemical Industry Co., Ltd.), 15 parts of a dispersion of zinc stearate (trade name: Hidorin Z-8-36, solids content: 36%, produced by Chukyo Yushi Co., Ltd.), and 20 parts of water was mixed to obtain a coating composition for heat-sensitive recording layers (3b).

Production of Heat-Sensitive Recording Material

The undercoat layer coating composition (3a) was applied to one side of high-quality paper (acidic paper having a hot-water extraction pH of 5.3) having a basis weight of 53 g/m$^2$ to a dry coat weight of 5.5 g/m$^2$ as a support by blade coating using a blade coater and dried to form an undercoat layer. The coating composition for heat-sensitive recording layers (3b) was applied to the undercoat layer to a dry coat weight of 3.5 g/m$^2$ by curtain coating using a slide-hopper curtain coater and dried, and then supercalendered to form a heat-sensitive recording layer.

Example 1-13

A heat-sensitive recording material was obtained in the same manner as in Example 1-12 except that in the preparation of the coating composition for heat-sensitive recording layers (3b) of Example 1-12, Liquid C3 was used in an amount of 6 parts in place of 18 parts, and that Liquid D3 was used in an amount of 30 parts in place of 18 parts.

Example 1-14

A heat-sensitive recording material was obtained in the same manner as in Example 1-12 except that in the preparation of the coating composition for heat-sensitive recording layers (3b) of Example 1-12, Liquid C3 was used in an amount of 30 parts in place of 18 parts, and that Liquid D3 was used in an amount of 6 parts in place of 18 parts.

Example 1-15

A heat-sensitive recording material was obtained in the same manner as in Example 1-12 except that in the preparation of the coating composition for heat-sensitive recording layers (3b) in Example 1-12, Liquid B3 was used in an amount of 45 parts in place of 28 parts, Liquid C3 was used in an amount of 9 parts in place of 18 parts, and Liquid D3 was used in an amount of 9 parts in place of 18 parts.

Example 1-16

A heat-sensitive recording material was obtained in the same manner as in Example 1-12 except that in the preparation of the coating composition for heat-sensitive recording layers (3b) of Example 1-12, Liquid B3 was used in an amount of 19 parts in place of 28 parts, Liquid C3 was used in an amount of 23 parts in place of 18 parts, and Liquid D3 was used in an amount of 23 parts in place of 18 parts.

Preparation of Liquid F3 (Developer Dispersion)

A composition consisting of 100 parts of a urea-urethane compound represented by formula (2) (trade name: UU, produced by Chemipro Kasei Kaisha, Ltd.), 5 parts of magnesium silicate, 50 parts of a 20% aqueous solution of sulfone-modified polyvinyl alcohol (trade name: Goselane L-3266, produced by The Nippon Synthetic Chemical Industry Co., Ltd.), 10 parts of a 5% emulsion of a glycerol ester emulsion antifoaming agent (trade name: Nopco 1407H, produced by San Nopco Co.), and 90 parts of water was pulverized with a sand mill to a median size of 1.0 μm as measured with a laser diffraction particle size analyzer (SALD2200 produced by Shimadzu Corporation) to obtain a dispersion. The dispersion was further heat-treated at 70° C. for 4 hours to obtain Liquid F3.

Example 1-17

A heat-sensitive recording material was obtained in the same manner as in Example 1-12 except that in the preparation of the coating composition for heat-sensitive recording layers (3b) of Example 1-12, Liquid F3 was used in place of Liquid D3.

Example 1-18

A heat-sensitive recording material was obtained in the same manner as in Example 1-12 except that in the preparation of the coating composition for heat-sensitive recording layers (3b) of Example 1-12, Liquid C3 was used in an amount of 36 parts in place of 18 parts, and Liquid D3 was not used.

Example 1-19

A heat-sensitive recording material was obtained in the same manner as in Example 1-12 except that in the preparation of the coating composition for heat-sensitive recording layers (3b) of Example 1-12, Liquid C3 was not used, and Liquid D3 was used in an amount of 36 parts in place of 18 parts.

Comparative Example 1-12

A heat-sensitive recording material was obtained in the same manner as in Example 1-12 except that in the preparation of the coating composition for heat-sensitive recording layers (3b) of Example 1-12, Liquid B3 was not used, Liquid C3 was used in an amount of 32 parts in place of 18 parts, and Liquid D3 was used in an amount of 32 parts in place of 18 parts.

Comparative Example 1-13

A heat-sensitive recording material was obtained in the same manner as in Example 1-12 except that in the preparation of the coating composition for heat-sensitive recording layers (3b) of Example 1-12, Liquid B3 was used in an amount of 64 parts in place of 28 parts, and neither Liquid C3 nor Liquid D3 was used.

Comparative Example 1-14

A heat-sensitive recording material was obtained in the same manner as in Example 1-12 except that in the preparation of Liquid B3 of Example 1-12, 4,4'-dihydroxydiphenylsulfone was used in place of N-[2-(3-phenylureido)phenyl]benzenesulfonamide.

The heat-sensitive recording materials thus obtained were evaluated for the following properties. Table 3 shows the results.

Recording Density 3

The recording density was evaluated in the same manner as in the "Recording Density 2" section above.

An image was recorded on each of the heat-sensitive recording materials at an applied energy of 0.25 mJ/dot using a thermal recording tester (trade name: TH-PMH, produced by Ohkura Electric Co., Ltd.). The optical density of the recorded area and unrecorded area (background portion) was measured with a reflection densitometer (trade name: Macbeth transmission reflection densitometer RD-918, produced by GretagMacbeth Co., Ltd.) in visual mode. The greater the numerical value, the higher the recording density. The recorded area preferably has a recording density of 1.20 or more for practical use. In the background portion, the smaller the numerical value, the more preferable. When the density of the background portion is more than 0.2, background fogging becomes problematic.

Heat Resistance 3

The heat resistance was evaluated in the same manner as in the "Heat Resistance 2" section above.

Oil Resistance

Salad oil was applied to the surface of the recorded area of each of the heat-sensitive recording materials that had been subjected to color development for measuring recording density. After the heat-sensitive recording materials were allowed to stand in an environment of 23° C. and 50% RH for 24 hours and the surface was wiped with gauze for treatment, the optical density of the recorded area was measured in visual mode with a reflection densitometer (trade name: Macbeth densitometer RD-918, produced by GretagMacbeth Co., Ltd.). The preservation percentage of the recorded area was calculated according to the following equation. The heat-sensitive recording material after the treatment preferably has a recording density of 1.0 or more and a preservation percentage of 60% or more.

$$\text{Preservation (\%)} = (\text{Recording density after treatment} / \text{Recording density before treatment}) \times 100$$

Plasticizer Resistance 3

The plasticizer resistance was evaluated in the same manner as in the "Plasticizer Resistance 2" section above.

Sticking Resistance

Using a thermal printer (trade name: L'esprit T8, produced by Sato Holdings Corporation), each of the heat-sensitive recording materials was subjected to color development to print an arbitrary pattern at 2 inch/sec (density: 5 A) and the print length from the start to the end of the print and print quality were checked with the naked eye, and evaluated according to the following criteria:

3: Both print length and print quality are satisfactory.

2: Print length is satisfactory, but print quality is slightly inferior due to blown-out highlights but is acceptable for practical use.

1: Print length is shorter or longer than the standard length, or print quality is unsatisfactory for practical use due to blown-out highlights, etc.

Head Residue Resistance

Using a thermal printer (trade name: L'esprit T8, produced by Sato Holdings Corporation), a 90-cm length of each of the heat-sensitive recording materials was color-developed at 4 inch/sec (density: 3 A). The adhesion of the residue to the thermal head was checked with the naked eye and evaluated according to the following criteria:

3: No adhesion of the residue is observed.

2: Very slight residue adhesion is observed but at a level acceptable for practical use.

1: Adhesion of the residue is observed at a level problematic for practical use.

TABLE 3

| | Recording density 3 | | Heat resistance 3 | Oil resistance 3 | | Plasticizer resistance 3 | | | Head |
|---|---|---|---|---|---|---|---|---|---|
| | Recorded part | Background portion | Background portion density | Recording density | Preservation (%) | Recording density | Preservation (%) | Sticking resistance | residue resistance |
| Example 1-12 | 1.26 | 0.06 | 0.10 | 1.20 | 95% | 1.19 | 94% | 3 | 3 |
| Example 1-13 | 1.24 | 0.06 | 0.10 | 1.16 | 94% | 1.15 | 93% | 3 | 2 |
| Example 1-14 | 1.27 | 0.06 | 0.11 | 1.20 | 94% | 1.19 | 94% | 2 | 2 |
| Example 1-15 | 1.29 | 0.06 | 0.10 | 1.08 | 84% | 1.07 | 83% | 3 | 3 |
| Example 1-16 | 1.18 | 0.06 | 0.12 | 1.14 | 97% | 1.14 | 97% | 3 | 3 |
| Example 1-17 | 1.26 | 0.06 | 0.09 | 1.20 | 95% | 1.19 | 94% | 3 | 3 |
| Example 1-18 | 1.27 | 0.06 | 0.11 | 1.20 | 94% | 1.19 | 94% | 1 | 1 |
| Example 1-19 | 1.24 | 0.06 | 0.10 | 1.16 | 94% | 1.15 | 93% | 2 | 1 |
| Comp. Ex. 1-12 | 0.99 | 0.07 | 0.13 | 0.81 | 82% | 0.80 | 81% | 2 | 2 |
| Comp. Ex. 1-13 | 1.32 | 0.06 | 0.09 | 0.70 | 53% | 0.68 | 52% | 3 | 3 |
| Comp. Ex. 1-14 | 1.28 | 0.06 | 0.35 | 0.65 | 51% | 0.66 | 52% | 3 | 3 |

Example 2-1

Preparation of Undercoat Layer Coating Composition (4a)

A composition consisting of 120 parts of a hollow plastic particle dispersion (trade name: Ropaque SN-1055, hollow ratio: 55%, average particle diameter: 1.0 μm, produced by The Dow Chemical Co., solids content: 26.5 mass %), 110 parts of a 50% aqueous dispersion of calcined kaolin (trade name: Ansilex, produced by BASF) (average particle diameter: 0.6 μm), 20 parts of styrene-butadiene latex (trade name: L-1571, produced by Asahi Kasei Chemicals Co., solids content: 48 wt %), 50 parts of 10% aqueous solution of oxidized starch, and 20 parts of water was mixed to obtain an undercoat layer coating composition (4a).

Preparation of Liquid A4 (Leuco Dye Dispersion)

A composition consisting of 100 parts of 3-di(n-butyl) amino-6-methyl-7-anilinofluoran, 50 parts of a 20% aqueous solution of sulfone-modified polyvinyl alcohol (trade name: Goselane L-3266, produced by The Nippon Synthetic Chemical Industry Co., Ltd.), 10 parts of a 5% emulsion of a glycerol ester emulsion antifoaming agent (trade name: Nopco 1407H, produced by San Nopco Co.), and 80 parts of water was pulverized with a sand mill to a median size of 0.5 μm as measured with a laser diffraction particle size distribution analyzer (SALD2200 produced by Shimadzu Corporation) to obtain Liquid A4.

Preparation of Liquid B4 (Developer Dispersion)

A composition consisting of 100 parts of N-[2-(3-phenylureido)phenyl]benzenesulfonamide, 50 parts of a 20% aqueous solution of sulfone-modified polyvinyl alcohol (trade name: Goselane L-3266, produced by The Nippon Synthetic Chemical Industry Co., Ltd.), 10 parts of a 5% emulsion of a glycerol ester emulsion antifoaming agent (trade name: Nopco 1407H, produced by San Nopco Co.), and 90 parts of water was pulverized with a sand mill to a median size of 1.0 μm as measured with a laser diffraction particle size distribution analyzer (SALD2200 produced by Shimadzu Corporation) to obtain Liquid B4.

Preparation of Liquid C4 (Sensitizer Dispersion)

A composition consisting of 100 parts of di-p-methylbenzyl oxalate, 50 parts of a 20% aqueous solution of sulfone-modified polyvinyl alcohol (trade name: Goselane L-3266, produced by The Nippon Synthetic Chemical Industry Co., Ltd.), 2 parts of a 5% emulsion of a glycerol ester emulsion antifoaming agent (trade name: Nopco 1407H, produced by San Nopco Co.), and 98 parts of water was pulverized with a sand mill to a median size of 1.0 μm as measured with a laser diffraction particle size distribution analyzer (SALD2200 produced by Shimadzu Corporation) to obtain Liquid C4.

Preparation of Coating Composition for Heat-Sensitive Recording Layers (4b)

A composition consisting of 25 parts of Liquid A4, 45 parts of Liquid B4, 45 parts of Liquid C4, 20 parts of aluminum hydroxide (trade name: HIGILITE H-42, average particle diameter: 1.0 μm, produced by Showa Denko K.K.), 10 parts of fine powder amorphous silica (trade name: Mizucasile P-605, average particle diameter: 3.0 μm, produced by Mizusawa Industrial Chemicals, Ltd.), 120 parts of a 10% aqueous solution of starch-vinylacetate graft copolymer (trade name: Petrocoat C-8, produced by Nippon Starch Chemical Co., Ltd.), 20 parts of a 10% aqueous solution of a fully saponified polyvinyl alcohol (trade name: Gohsenol NM-11, produced by The Nippon Synthetic Chemical Industry Co., Ltd.), 15 parts of a dispersion of zinc stearate (trade name: Hidorin Z-8-36, solids content: 36%, produced by Chukyo Yushi Co., Ltd.), and 20 parts of water was mixed to obtain a coating composition for heat-sensitive recording layers (4b).

Production of Heat-Sensitive Recording Material

The undercoat layer coating composition (4c) was applied to one side of neutral paper (hot-water extraction pH of 8.8) having a basis weight of 53 g/m$^2$ to a dry coat weight of 5.5 g/m$^2$ by blade coating using a blade coater and dried to form an undercoat layer. Subsequently, the coating composition for heat-sensitive recording layers (4b) was applied to the undercoat layer to a dry coat weight of 3.5 g/m$^2$ using a rod coater and dried, and then supercalendered to form a heat-sensitive recording material.

Example 2-2

A heat-sensitive recording material was obtained in the same manner as in Example 2-1 except that in the preparation of the coating composition for heat-sensitive recording layers (4b) of Example 2-1, Liquid B4 was used in an amount of 125 parts in place of 45 parts.

Example 2-3

A heat-sensitive recording material was obtained in the same manner as in Example 2-1 except that in the preparation of the coating composition for heat-sensitive recording layers (4b) of Example 2-1, Liquid B4 was used in an amount of 13 parts in place of 45 parts.

Example 2-4

A heat-sensitive recording material was obtained in the same manner as in Example 2-1 except that in the production of the heat-sensitive recording material of Example 2-1, neutral paper (hot-water extraction pH of 6.5) having a basis weight of 53 g/m$^2$ was used in place of neutral paper (hot-water extraction pH of 8.8) having a basis weight of 53 g/m$^2$.

Example 2-5

A heat-sensitive recording material was obtained in the same manner as in Example 2-1 except that in the production of the heat-sensitive recording material of Example 2-1, neutral paper (hot-water extraction pH of 10) having a basis weight of 53 g/m$^2$ was used in place of neutral paper (hot-water extraction pH of 8.8) having a basis weight of 53 g/m$^2$.

Comparative Example 2-1

A heat-sensitive recording material was obtained in the same manner as in Example 2-1 except that in the preparation of Liquid B4 of Example 2-1, 4-hydroxy-4'-isopropoxydiphenylsulfone (trade name: D-8, produced by Nippon Soda Co., Ltd.) was used in place of N-[2-(3-phenylureido)phenyl]benzenesulfonamide.

Comparative Example 2-2

A heat-sensitive recording material was obtained in the same manner as in Example 2-1 except that in the preparation of Liquid B4 of Example 2-1, N-p-toluenesulfonyl-N'-3-(p-toluenesulfonyloxy)phenylurea (trade name: PF-201, produced by BASF) was used in place of N-[2-(3-phenylureido)phenyl]benzenesulfonamide.

Comparative Example 2-3

A heat-sensitive recording material was obtained in the same manner as in Example 2-1 except that in the preparation of Liquid B4 of Example 2-1, 4,4'-dihydroxydiphenylsulfone was used in place of N-[2-(3-phenylureido)phenyl]benzenesulfonamide.

The heat-sensitive recording materials thus obtained were evaluated for the following properties. Table 4 shows the results.

Recording Density 4

The recording density was measured and evaluated in the same manner as in the "Recording Density 2" section above.

Heat Resistance 4

After each of the heat-sensitive recording materials before recording was allowed to stand in a high-temperature environment of 80° C. for 24 hours, the optical density of the unrecorded area (background portion) was measured with a reflection densitometer (trade name: Macbeth densitometer RD-918, produced by GretagMacbeth Macbeth) in visual mode. The smaller the numerical value, the more preferable. When the density of the background portion is more than 0.2, background fogging becomes problematic.

Plasticizer Resistance 4

A wrap film (trade name: Hi-S Soft, produced by Nippon Carbide Industries Co., Ltd.) was wound around a polycarbonate pipe (diameter: 40 mm) three times, and each of the heat-sensitive recording materials that had been subjected to color development for measuring the recording density was placed on the film. The wrap film was further wound around the heat-sensitive recording material three times and allowed to stand at 23° C. and 50% RH for 12 hours for treatment. The optical density of the recorded area was then measured with a reflection densitometer (trade name: Macbeth transmission reflection densitometer RD-918, produced by GretagMacbeth Co., Ltd.) in visual mode. Further, the preservation percentage of the recorded area was calculated according to the following equation. When the heat-sensitive recording material after the treatment has a recording density of 1.0 or more and a preservation percentage of 60% or more, the heat-sensitive recording material is satisfactory.

$$\text{Preservation (\%)} = (\text{Recording density after treatment} / \text{Recording density before treatment}) \times 100$$

Blank-Paper Preservability

After each of the heat-sensitive recording materials before recording was stored in a blank (unrecorded) state in an environment of 40° C. and 90% RH for 7 days as an accelerated test, an image was recorded on the heat-sensitive recording materials at an applied energy of 0.28 mJ/dot using a thermal recording tester (trade name: TH-PMH, produced by Ohkura Electric Co., Ltd.), and the optical density of the recorded area was measured with a reflection densitometer (trade name: Macbeth transmission reflection densitometer RD-918, produced by GretagMacbeth Co., Ltd.) in visual mode. The blank-paper preservability was evaluated according to the following criteria. Print reproducibility was calculated according to the following equation.

$$\text{Print reproducibility (\%)} = (\text{Recording density after storage} / \text{Recording density before storage}) \times 100$$

3: The print reproducibility is 80% or more; no problem at all.

2: The print reproducibility is 65% or more and less than 80%; satisfactory for practical use.

1: The print reproducibility is less than 65%; unsatisfactory for practical use.

TABLE 4

| | Recording density 4 | | Heat resistance 4 | Plasticizer resistance 4 | | Blank-paper preservability | | |
|---|---|---|---|---|---|---|---|---|
| | Recorded part | Background portion | Background portion density | Recording density | Preservation (%) | Recording density | Reproducibility | Evaluation |
| Example 2-1 | 1.35 | 0.06 | 0.10 | 1.25 | 93% | 1.25 | 93% | 3 |
| Example 2-2 | 1.41 | 0.07 | 0.12 | 1.35 | 96% | 1.32 | 94% | 3 |
| Example 2-3 | 1.22 | 0.06 | 0.09 | 1.10 | 90% | 1.10 | 90% | 3 |
| Example 2-4 | 1.36 | 0.07 | 0.11 | 1.26 | 93% | 1.28 | 94% | 3 |
| Example 2-5 | 1.34 | 0.06 | 0.10 | 1.24 | 93% | 1.23 | 92% | 3 |
| Comp. Ex. 2-1 | 1.38 | 0.08 | 0.30 | 0.40 | 29% | 1.27 | 92% | 3 |
| Comp. Ex. 2-2 | 1.32 | 0.07 | 0.12 | 1.26 | 95% | 0.68 | 52% | 1 |
| Comp. Ex. 2-3 | 1.28 | 0.07 | 0.13 | 0.65 | 51% | 0.90 | 70% | 2 |

INDUSTRIAL APPLICABILITY

The heat-sensitive recording material according to the present invention has a high recording density, does not have a background fogging problem even when stored at a high temperature, and also has excellent plasticizer resistance and alcohol resistance in recorded portions. Therefore, the heat-sensitive recording material is suitable for receipts and labels.

The heat-sensitive recording material according to another embodiment of the present invention has excellent blank-paper preservability in addition to the above properties. Therefore, neutral paper can be suitably used as a support for receipts and food labels.

The invention claimed is:

1. A heat-sensitive recording material comprising at least a heat-sensitive recording layer formed on a support, the heat-sensitive recording layer comprising a leuco dye and developers, the developers including a sulfonamide compound represented by formula (1):

(1)

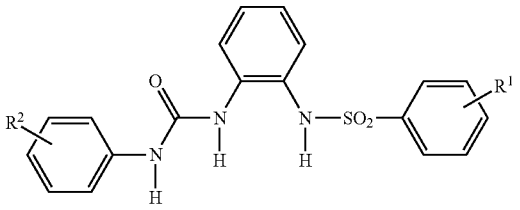

wherein $R^1$ and $R^2$ may be the same or different, and each represents a hydrogen atom, an alkyl group having 1 to 4 carbon atoms, an alkoxy group having 1 to 4 carbon atoms, or a halogen atom, and further including at least one member selected from the group consisting of a urea-urethane compound represented by formula (2):

(2)

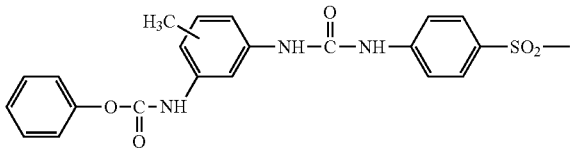

-continued

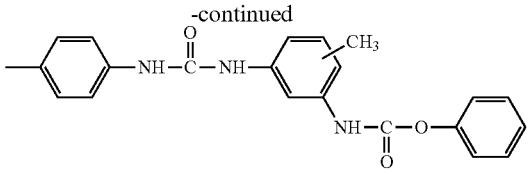

and a diphenylsulfone-crosslinked compound represented by formula (3):

(3)

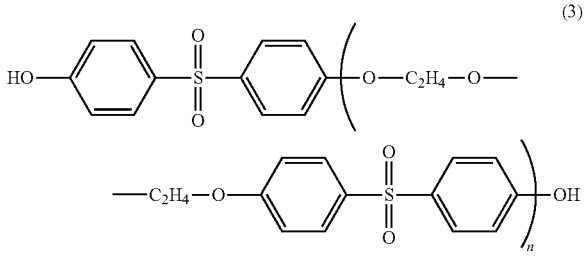

wherein is an integer of 1 to 6.

2. The heat-sensitive recording material according to claim 1, wherein the sulfonamide compound represented by formula (1) is N-[2-(3-phenylureido)phenyl]benzenesulfonamide.

3. The heat-sensitive recording material according to claim 1, wherein the developers include the sulfonamide compound represented by formula (1), the urea-urethane compound represented by formula (2), and the diphenylsulfone-crosslinked compound represented by formula (3).

4. The heat-sensitive recording material according to claim 1, wherein the sulfonamide compound represented by formula (1) is present in an amount of 0.5 to 5 parts by mass per part by mass of the leuco dye.

5. The heat-sensitive recording material according to claim 1, wherein the urea-urethane compound represented by formula (2) is present in an amount of 0.03 to 2.5 parts by mass per part by mass of the sulfonamide compound represented by formula (1).

6. The heat-sensitive recording material according to claim 1, wherein the diphenylsulfone-crosslinked compound represented by formula (3) is present in amount of 0.1 to 2.5 parts by mass per part by mass of the sulfonamide compound represented by formula (1).

7. The heat-sensitive recording material according to claim 1, wherein the urea-urethane compound represented by formula (2) is present in an amount of 0.2 to 5 parts by mass per part by mass of the diphenylsulfone-crosslinked compound represented by formula (3).

8. The heat-sensitive recording material according to claim 1, wherein the total amount of the urea-urethane compound represented by formula (2) and the diphenylsulfone-crosslinked compound represented by formula (3) is 0.2 to 3 parts by mass per part by mass of the sulfonamide compound represented by formula (1).

9. The heat-sensitive recording material according to claim 8, wherein the urea-urethane compound represented by formula (2) and the diphenylsulfone-crosslinked compound represented by formula (3) are each present in an amount of 2.5 mass% or more, and the sulfonamide compound represented by formula (1) is present in an amount of 15 to 90 mass%, based on the total amount of the developers.

10. The heat-sensitive recording material according to claim 1, wherein the urea-urethane compound of formula (2) contained as a developer is a compound heat-treated in advance in the presence of a basic inorganic pigment.

11. The heat-sensitive recording material according to claim 1, wherein the urea-urethane compound represented by formula (2) is at least one member selected from the group consisting of 4,4'-bis[(4-methyl-3-phenoxycarbonylaminophenyl)ureido]diphenylsulfonedelete, 4,4'-bis[(2-methyl-5-phenoxycarbonylaminophenyOureido] diphenylsulfone, and 4-(2-methyl-3-phenoxycarbonylaminophenyl) ureido-4'-(4-methyl-5-phenoxycarbonylaminophenyl) ureidodiphenylsulfone.

12. The heat-sensitive recording material according to claim 1, wherein the support is neutral or acidic paper made from a pulp slurry containing pulp fiber, a filler, and a sizing agent.

13. The heat-sensitive recording material according to claim 1, wherein the heat-sensitive recording layer comprises as a sensitizer at least one member selected from the group consisting of stearamide, 2-naphthyl benzyl ether, di-p-chlorobenzyl oxalate, di-p-methylbenzyl oxalate, 1,2-di(3-methylphenoxy)ethane, 1,2-diphenoxyethane, and diphenylsulfone.

14. A heat-sensitive recording material comprising a support, an undercoat layer, and a heat-sensitive recording layer, the undercoat layer comprising a pigment and a binder and formed on the support, the heat-sensitive recording layer comprising a leuco dye and a developer and formed on the undercoat layer, the support being neutral paper, and the developer comprising a sulfonamide compound represented by formula (1):

(1)

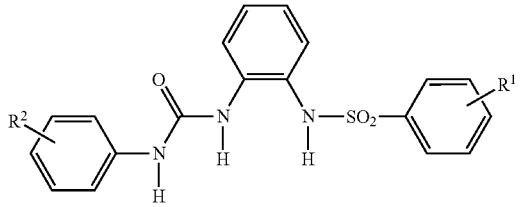

wherein $R^1$and $R^2$ may the same or different, and each represents a hydrogen atom and an alkyl group having 1 to 4 carbon atoms, an alkoxy group having 1 to 4 carbon atoms, or a halogen atom.

15. The heat-sensitive recording material according to claim 14, wherein the sulfonamide compound represented by formula (1) is N-[2-(3-phenylureido)phenyl]benzenesulfonamide.

16. The heat-sensitive recording material according to claim 14, wherein the neutral paper has a hot-water extraction pH of 6.0 to 11, based on JIS P 8133.

17. The heat-sensitive recording material according to claim 14, wherein the sulfonamide compound represented by formula (1) is present in an amount of 0.5 to 5 parts by mass per part by mass of the leuco dye.

18. The heat-sensitive recording material according to claim 14, wherein the undercoat layer comprises hollow plastic particles as a pigment in an amount of 2 to 90 mass%, based on the total solids content of the undercoat layer.

* * * * *